US007171145B2

(12) United States Patent
Takeuchi et al.

(10) Patent No.: US 7,171,145 B2
(45) Date of Patent: Jan. 30, 2007

(54) DEVELOPING DEVICE AND PROCESS CARTRIDGE FOR AN IMAGE FORMING APPARATUS

(75) Inventors: Nobutaka Takeuchi, Kanagawa (JP); Hajime Oyama, Chiba (JP); Hiromitsu Takagaki, Kanagawa (JP); Takayuki Koike, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/349,244

(22) Filed: Feb. 8, 2006

(65) Prior Publication Data

US 2006/0127136 A1 Jun. 15, 2006

Related U.S. Application Data

(62) Division of application No. 10/734,292, filed on Dec. 15, 2003, now Pat. No. 7,024,141.

(30) Foreign Application Priority Data

Dec. 13, 2002 (JP) ..... 2002-362964
Dec. 19, 2002 (JP) ..... 2002-368680
Mar. 31, 2003 (JP) ..... 2003-096502

(51) Int. Cl.
*G03G 15/09* (2006.01)

(52) U.S. Cl. ..... 399/274; 399/267; 399/275; 430/110.4

(58) Field of Classification Search ..... 399/274, 399/275, 284, 267; 118/261; 430/122, 109.4, 430/110.4
See application file for complete search history.

(56) References Cited

U.S. PATENT DOCUMENTS 4,800,412 A * 1/1989 Ueda ..... 399/275 X
4,916,492 A * 4/1990 Hoshika et al. ..... 399/274 X
5,708,940 A 1/1998 Hosaka et al. ..... 399/266
5,758,241 A * 5/1998 Oyama et al. ..... 399/275 X
5,991,587 A 11/1999 Kikuchi ..... 399/282
6,035,169 A * 3/2000 Miyake et al. ..... 399/258
6,067,433 A * 5/2000 Kimura et al. ..... 399/274

(Continued)

FOREIGN PATENT DOCUMENTS

JP 06-266221 A 9/1994

(Continued)

*Primary Examiner*—Sophia S. Chen
(74) *Attorney, Agent, or Firm*—Oblon, Spivak, McClelland, Maier & Neustadt, P.C.

(57) ABSTRACT

A method of developing a latent image formed on an image carrier with toner, including causing a developer carrier, which faces the image carrier and accommodates a magnet therein, to support a developer having a toner and a magnetic carrier supporting the toner and convey the developer to a developing zone between the developer carrier and the image carrier, and providing an apparent coating ratio M of a surface of the developer carrier coated with the developer. The coating ration M is, in a zone upstream of the developing zone in a direction of rotation of the developer carrier, expressed as $M=\alpha A2+\beta$ (%), where $\alpha$ denotes a coefficient of the coating ratio, A2 denotes an amount of developer for a unit area, $\beta$ denotes a value determined by a powder characteristic of the developer for an apparent coating ratio calculated with A2=0, and the coating ratio M is between 90% and 120%.

12 Claims, 24 Drawing Sheets

U.S. PATENT DOCUMENTS

| | | | | |
|---|---|---|---|---|
| 6,198,895 | B1 * | 3/2001 | Tsuda et al. | 399/267 |
| 6,528,224 | B2 * | 3/2003 | Ohno et al. | 430/110.4 X |
| 6,810,222 | B2 * | 10/2004 | Ohyama | 399/275 X |
| 2002/0051924 | A1 * | 5/2002 | Iida et al. | 430/109.3 |
| 2003/0027074 | A1 | 2/2003 | Emoto et al. | 430/124 |
| 2003/0138717 | A1 | 7/2003 | Yagi et al. | 430/110.4 |
| 2003/0219669 | A1 | 11/2003 | Yamashita et al. | 430/109.4 |
| 2004/0053154 | A1 | 3/2004 | Yomita et al. | 430/109.4 |
| 2004/0157146 | A1 | 8/2004 | Tomita et al. | 430/108.9 |
| 2004/0175641 | A1 | 9/2004 | Nanya et al. | 430/109.4 |
| 2004/0265015 | A1 | 12/2004 | Kioke et al. | 399/274 |

FOREIGN PATENT DOCUMENTS

| | | | |
|---|---|---|---|
| JP | 09-251243 | A | 9/1997 |
| JP | 2001-005294 | A | 1/2001 |
| JP | 2003-228229 | A | 8/2003 |

* cited by examiner

FIG. 6

| | TORQUE (kgf/cm) | $\theta_1$ | $\theta_d$ | $\theta_d/\theta_1$ |
|---|---|---|---|---|
| CONDITION 1 | 1.6 | 45 | 30 | 2/3 |
| CONDITION 2 | 1.3 | 45 | 20 | 4/9 |
| CONDITION 3 | 1.2 | 45 | 18 | 2/5 |
| CONDITION 4 | 1.0 | 45 | 15 | 1/3 |
| CONDITION 5 | 0.7 | 45 | 10 | 2/9 |
| CONDITION 6 | 1.8 | 30 | 30 | 1 |
| CONDITION 7 | 1.7 | 30 | 25 | 5/6 |
| CONDITION 8 | 1.3 | 30 | 18 | 3/5 |
| CONDITION 9 | 1.1 | 30 | 12 | 2/5 |
| CONDITION 10 | 0.9 | 30 | 8 | 4/15 |

| r1/r | STABILITY |
|---|---|
| 1/1 | × |
| 1/2 | × |
| 1/3 | O |
| 1/4 | O |

FIG. 17

| | GRANULARITY | Dv/Dn | CIRCULARITY |
|---|---|---|---|
| TONER 1 | 6.8 | 1.32 | 0.89 |
| TONER 2 | 5.5 | 1.15 | 0.97 |
| TONER 3 | 4.2 | 1.10 | 0.94 |
| TONER 4 | 7.8 | 1.24 | 0.96 |
| TONER 5 | 3.5 | 1.19 | 0.96 |
| TONER 6 | 8.2 | 1.15 | 0.95 |

FIG. 18A

FIG. 18 FIG. 18A FIG. 18B

| | TOTAL AMOUNT (g) | AMOUNT OF SLEEVE (g) | METERING MEMBER | TONER |
|---|---|---|---|---|
| CONDITION 1 | 200 | 90 | NONMAGNETIC | TONER 1 |
| CONDITION 2 | 200 | 90 | MAGNETIC | TONER 2 |
| CONDITION 3 | 200 | 90 | MAGNETIC | TONER 3 |
| CONDITION 4 | 200 | 90 | MAGNETIC | TONER 4 |
| CONDITION 5 | 200 | 90 | MAGNETIC | TONER 5 |
| CONDITION 6 | 200 | 90 | MAGNETIC | TONER 6 |
| CONDITION 7 | 200 | 90 | MAGNETIC | TONER 2 |
| CONDITION 8 | 200 | 90 | MAGNETIC | TONER 2 |
| CONDITION 9 | 200 | 90 | MAGNETIC | TONER 2 |
| CONDITION 10 | 200 | 120 | MAGNETIC | TONER 2 |
| CONDITION 11 | 200 | 150 | MAGNETIC | TONER 2 |
| CONDITION 12 | 300 | 140 | MAGNETIC | TONER 2 |
| CONDITION 13 | 300 | 180 | MAGNETIC | TONER 2 |
| CONDITION 14 | 400 | 190 | NONMAGNETIC | TONER 2 |
| CONDITION 15 | 400 | 220 | NONMAGNETIC | TONER 2 |

FIG. 18B

| CARRIER | GRANU-LARITY | TONER SCATTERING | BACK-GROUND FOG | CARRIER DEPOSITION | CARRIER CHARGING |
|---|---|---|---|---|---|
| CARRIER 1 | △ | ○ | ○ | ○ | △ |
| CARRIER 1 | ◎ | ○ | ○ | ○ | ○ |
| CARRIER 1 | ○ | ○ | ○ | ○ | ○ |
| CARRIER 1 | △ | ◎ | ○ | ○ | ○ |
| CARRIER 1 | △ | △ | △ | ○ | ○ |
| CARRIER 1 | △ | ○ | ○ | ○ | ○ |
| CARRIER 2 | ◎ | ○ | ○ | △ | ○ |
| CARRIER 3 | △ | △ | △ | ○ | △ |
| CARRIER 4 | ○ | × | × | △ | × |
| CARRIER 1 | ◎ | △ | △ | ○ | × |
| CARRIER 1 | ◎ | × | × | ○ | × |
| CARRIER 1 | ◎ | ○ | ○ | ○ | ○ |
| CARRIER 1 | ◎ | △ | △ | ○ | × |
| CARRIER 1 | ◎ | ○ | ○ | ○ | △ |
| CARRIER 1 | ◎ | △ | ○ | ○ | × |

FIG. 22A

CARRIER GRAIN SIZE: 55 μm

| | Gp(cm) | ρc(g/cm³) | ργ(g/cm³) | A(g/cm²) | APPARENT COATING RATIO M |
|---|---|---|---|---|---|
| CONDITION 1 | 0.05 | 5.2 | 2.2 | 0.07 | 125 |
| CONDITION 2 | 0.05 | 5.2 | 2.2 | 0.06 | 110 |
| CONDITION 3 | 0.05 | 5.2 | 2.2 | 0.05 | 100 |
| CONDITION 4 | 0.05 | 5.2 | 2.2 | 0.04 | 70 |
| CONDITION 5 | 0.05 | 5.2 | 2.2 | 0.03 | 60 |
| CONDITION 6 | 0.05 | 5.2 | 2.2 | 0.02 | 55 |
| CONDITION 7 | 0.04 | 5.2 | 2.2 | 0.07 | 125 |
| CONDITION 8 | 0.04 | 5.2 | 2.2 | 0.06 | 110 |
| CONDITION 9 | 0.04 | 5.2 | 2.2 | 0.05 | 100 |
| CONDITION 10 | 0.04 | 5.2 | 2.2 | 0.04 | 70 |
| CONDITION 11 | 0.04 | 5.2 | 2.2 | 0.03 | 60 |
| CONDITION 12 | 0.04 | 5.2 | 2.2 | 0.02 | 55 |
| CONDITION 13 | 0.03 | 5.2 | 2.2 | 0.07 | 125 |
| CONDITION 14 | 0.03 | 5.2 | 2.2 | 0.06 | 110 |
| CONDITION 15 | 0.03 | 5.2 | 2.2 | 0.05 | 100 |
| CONDITION 16 | 0.03 | 5.2 | 2.2 | 0.04 | 70 |
| CONDITION 17 | 0.03 | 5.2 | 2.2 | 0.03 | 60 |
| CONDITION 18 | 0.03 | 5.2 | 2.2 | 0.02 | 55 |
| CONDITION 19 | 0.02 | 5.2 | 2.2 | 0.07 | 125 |
| CONDITION 20 | 0.02 | 5.2 | 2.2 | 0.06 | 110 |
| CONDITION 21 | 0.02 | 5.2 | 2.2 | 0.05 | 100 |
| CONDITION 22 | 0.02 | 5.2 | 2.2 | 0.04 | 70 |
| CONDITION 23 | 0.02 | 5.2 | 2.2 | 0.03 | 60 |
| CONDITION 24 | 0.02 | 5.2 | 2.2 | 0.02 | 55 |

FIG. 22

FIG. 22A

FIG. 22B

FIG. 22B

| Gp × ρr | CARRIER DEPOSITION | ROUGHNESS | SOLID IMAGE DENSITY | OMISSION AROUND SOLID | TONER SCATTERING |
|---|---|---|---|---|---|
| 0.11 | × | O | O | × | × |
| 0.11 | O | O | O | × | O |
| 0.11 | O | O | O | × | O |
| 0.11 | O | × | O | × | O |
| 0.11 | O | × | × | × | × |
| 0.11 | × | × | × | × | × |
| 0.09 | × | O | O | O | O |
| 0.09 | O | O | O | O | O |
| 0.09 | O | × | O | O | O |
| 0.09 | O | × | O | O | O |
| 0.09 | O | × | O | × | O |
| 0.09 | O | × | × | × | × |
| 0.07 | × | O | O | × | × |
| 0.07 | O | O | O | O | O |
| 0.07 | O | O | O | O | O |
| 0.07 | O | × | O | O | O |
| 0.07 | O | × | O | O | O |
| 0.07 | O | × | O | O | O |
| 0.04 | × | O | O | O | O |
| 0.04 | O | O | O | O | O |
| 0.04 | O | O | O | O | O |
| 0.04 | × | × | O | O | O |
| 0.04 | O | × | O | O | O |
| 0.04 | O | × | O | × | O |

FIG. 23A

CARRIER GRAIN SIZE: 35 μm

| | Gp(cm) | ρc(g/cm³) | ρr(g/cm³) | A(g/cm²) | APPARENT COATING RATIO M |
|---|---|---|---|---|---|
| CONDITION 1 | 0.05 | 5.2 | 1.8 | 0.07 | 140 |
| CONDITION 2 | 0.05 | 5.2 | 1.8 | 0.06 | 130 |
| CONDITION 3 | 0.05 | 5.2 | 1.8 | 0.05 | 120 |
| CONDITION 4 | 0.05 | 5.2 | 1.8 | 0.04 | 100 |
| CONDITION 5 | 0.05 | 5.2 | 1.8 | 0.03 | 90 |
| CONDITION 6 | 0.05 | 5.2 | 1.8 | 0.02 | 80 |
| CONDITION 7 | 0.04 | 5.2 | 1.8 | 0.07 | 140 |
| CONDITION 8 | 0.04 | 5.2 | 1.8 | 0.06 | 130 |
| CONDITION 9 | 0.04 | 5.2 | 1.8 | 0.05 | 120 |
| CONDITION 10 | 0.04 | 5.2 | 1.8 | 0.04 | 100 |
| CONDITION 11 | 0.04 | 5.2 | 1.8 | 0.03 | 90 |
| CONDITION 12 | 0.04 | 5.2 | 1.8 | 0.02 | 80 |
| CONDITION 13 | 0.03 | 5.2 | 1.8 | 0.07 | 140 |
| CONDITION 14 | 0.03 | 5.2 | 1.8 | 0.06 | 130 |
| CONDITION 15 | 0.03 | 5.2 | 1.8 | 0.05 | 120 |
| CONDITION 16 | 0.03 | 5.2 | 1.8 | 0.04 | 100 |
| CONDITION 17 | 0.03 | 5.2 | 1.8 | 0.03 | 90 |
| CONDITION 18 | 0.03 | 5.2 | 1.8 | 0.02 | 80 |
| CONDITION 19 | 0.02 | 5.2 | 1.8 | 0.07 | 140 |
| CONDITION 20 | 0.02 | 5.2 | 1.8 | 0.06 | 130 |
| CONDITION 21 | 0.02 | 5.2 | 1.8 | 0.05 | 120 |
| CONDITION 22 | 0.02 | 5.2 | 1.8 | 0.04 | 100 |
| CONDITION 23 | 0.02 | 5.2 | 1.8 | 0.03 | 90 |
| CONDITION 24 | 0.02 | 5.2 | 1.8 | 0.02 | 80 |

FIG. 23

FIG. 23A

FIG. 23B

FIG. 23B

| Gp × ρr | CARRIER DEPOSITION | ROUGHNESS | SOLID IMAGE DENSITY | OMISSION AROUND SOLID | TONER SCATTERING |
|---|---|---|---|---|---|
| 0.09 | × | O | O | × | × |
| 0.09 | O | O | O | × | O |
| 0.09 | O | O | O | O | O |
| 0.09 | O | O | O | O | O |
| 0.09 | O | × | O | O | O |
| 0.09 | O | × | × | × | × |
| 0.07 | × | O | O | × | × |
| 0.07 | O | O | O | × | O |
| 0.07 | O | O | O | O | O |
| 0.07 | O | O | O | O | O |
| 0.07 | O | O | O | O | O |
| 0.07 | O | × | × | O | O |
| 0.05 | × | O | O | × | × |
| 0.05 | × | O | O | × | O |
| 0.05 | O | O | O | × | O |
| 0.05 | O | O | O | O | O |
| 0.05 | O | O | O | O | O |
| 0.05 | O | × | O | O | O |
| 0.04 | × | O | O | × | × |
| 0.04 | × | O | O | × | × |
| 0.04 | O | O | O | O | O |
| 0.04 | O | O | O | O | O |
| 0.04 | O | O | O | O | O |
| 0.04 | O | × | O | O | O |

FIG. 24A

CARRIER GRAIN SIZE: 25 μm

| | Gp(cm) | ρc(g/cm³) | ργ(g/cm³) | A(g/cm²) | APPARENT COATING RATIO M |
|---|---|---|---|---|---|
| CONDITION 1 | 0.05 | 5.2 | 1.5 | 0.07 | 150 |
| CONDITION 2 | 0.05 | 5.2 | 1.5 | 0.06 | 140 |
| CONDITION 3 | 0.05 | 5.2 | 1.5 | 0.05 | 130 |
| CONDITION 4 | 0.05 | 5.2 | 1.5 | 0.04 | 120 |
| CONDITION 5 | 0.05 | 5.2 | 1.5 | 0.03 | 110 |
| CONDITION 6 | 0.05 | 5.2 | 1.5 | 0.02 | 100 |
| CONDITION 7 | 0.04 | 5.2 | 1.5 | 0.07 | 150 |
| CONDITION 8 | 0.04 | 5.2 | 1.5 | 0.06 | 140 |
| CONDITION 9 | 0.04 | 5.2 | 1.5 | 0.05 | 130 |
| CONDITION 10 | 0.04 | 5.2 | 1.5 | 0.04 | 120 |
| CONDITION 11 | 0.04 | 5.2 | 1.5 | 0.03 | 110 |
| CONDITION 12 | 0.04 | 5.2 | 1.5 | 0.02 | 100 |
| CONDITION 13 | 0.03 | 5.2 | 1.5 | 0.07 | 150 |
| CONDITION 14 | 0.03 | 5.2 | 1.5 | 0.06 | 140 |
| CONDITION 15 | 0.03 | 5.2 | 1.5 | 0.05 | 130 |
| CONDITION 16 | 0.03 | 5.2 | 1.5 | 0.04 | 120 |
| CONDITION 17 | 0.03 | 5.2 | 1.5 | 0.03 | 110 |
| CONDITION 18 | 0.03 | 5.2 | 1.5 | 0.02 | 100 |
| CONDITION 19 | 0.02 | 5.2 | 1.5 | 0.07 | 150 |
| CONDITION 20 | 0.02 | 5.2 | 1.5 | 0.06 | 140 |
| CONDITION 21 | 0.02 | 5.2 | 1.5 | 0.05 | 130 |
| CONDITION 22 | 0.02 | 5.2 | 1.5 | 0.04 | 120 |
| CONDITION 23 | 0.02 | 5.2 | 1.5 | 0.03 | 110 |
| CONDITION 24 | 0.02 | 5.2 | 1.5 | 0.02 | 100 |

FIG. 24

FIG. 24A

FIG. 24B

FIG. 24B

| Gp × ργ | CARRIER DEPOSITION | ROUGHNESS | SOLID IMAGE DENSITY | OMISSION AROUND SOLID | TONER SCATTERING |
|---|---|---|---|---|---|
| 0.08 | × | O | O | × | × |
| 0.08 | × | O | O | × | O |
| 0.08 | × | O | O | O | O |
| 0.08 | × | O | O | O | O |
| 0.08 | × | O | O | O | O |
| 0.08 | × | × | × | × | × |
| 0.06 | × | O | O | × | × |
| 0.06 | × | O | O | × | O |
| 0.06 | O | O | O | × | O |
| 0.06 | O | O | O | O | O |
| 0.06 | O | O | O | O | O |
| 0.06 | O | O | O | O | O |
| 0.05 | × | O | O | × | × |
| 0.05 | × | O | O | × | × |
| 0.05 | × | O | O | × | O |
| 0.05 | O | O | O | O | O |
| 0.05 | O | O | O | O | O |
| 0.05 | O | O | O | O | O |
| 0.03 | × | O | O | × | O |
| 0.03 | × | O | O | × | O |
| 0.03 | × | O | O | × | O |
| 0.03 | O | O | O | O | × |
| 0.03 | O | O | O | O | O |
| 0.03 | O | O | O | O | O |

DEVELOPING DEVICE AND PROCESS CARTRIDGE FOR AN IMAGE FORMING APPARATUS

CROSS-REFERENCE TO RELATED APPLICATIONS

This application is a Divisional of U.S. patent application Ser. No. 10/734,292, filed Dec. 15, 2003 now U.S. Pat. No. 7,024,141 and claims priority to Japanese Patent Application No. 2002-362964, filed Dec. 13, 2002, Japanese Patent Application No. 2002-368680, filed Dec. 19, 2002, and Japanese Patent Application No. 2003-096502, filed Mar. 31, 2003. The contents of these applications are incorporated herein by reference in their entirety.

BACKGROUND OF THE INVENTION

1. Field of the Invention

The present invention relates to a copier, printer, facsimile apparatus or similar image forming apparatus and more particularly to a developing device for forming an image with a two-ingredient type developer made up of toner grains and magnetic carrier grains and a process cartridge including the same.

2. Description of the Background Art

It is a common practice with an image forming apparatus to form a toner image by using a photoconductive element or image carrier provided with a photoconductive layer on its surface and a developing device. A two-ingredient type developer, made up of a toner and a magnetic carrier, is extensively applied to the developing device because it is feasible for color image formation. When the developer is frictionally charged in the developing device due to agitation, the resulting electrostatic charge causes the toner to electrostatically deposit on the carrier. The carrier, thus supporting the toner thereon, is magnetically deposited on a sleeve or developer carrier, which accommodates a stationary magnet roller therein, and is conveyed on the sleeve due to the rotation of the sleeve.

The magnet roller includes a main pole for development located at a position where the sleeve adjoins the photoconductive element. When the developer being conveyed approaches the main pole, a number of carrier grains included in the developer gather and form brush chains, or a magnet brush, along the magnetic lines of force of the main pole. In a magnet brush type of developing system, it is generally accepted that the carrier, which is dielectric, increases the field strength between the photoconductive element and the sleeve to thereby cause the toner to move from the carrier around the tips of the brush chains to a latent image formed on the photoconductive element.

In an image forming apparatus of the type developing a latent image by conveying a developer deposited on a sleeve to a developing zone where the sleeve faces a photoconductive element, a doctor or metering member is usually configured to face the circumference of the sleeve at a preselected gap. In the magnet brush type of developing device, the doctor meters the developer brought to the above gap or doctor gap by the sleeve for thereby regulating the amount of the developer to reach the developing zone.

As for toner grains for use in the magnet brush type of developing system, inorganic fine grains of silica or titanium oxide should preferably be selectively deposited on the surfaces of toner grains as an additive. Such an additive enhances the fluidity of the toner grains and therefore the dispersion and rapid charging of the toner grains when the toner grains are replenished, thereby contributing to the formation of high-quality images.

However, the problem with the developer is that heavy stresses acts on the developer due to a long time of mixing and agitation and the presence of the doctor. The stresses cause the additive to part from the toner grains or be buried in the same and bring about the separation of carrier coating layers as well as toner spent, rendering the amount of charge to deposit on the toner grains unstable and reducing the durability of the entire developer.

More specifically, the inorganic fine grains of silica, titanium oxide or similar additive deposited on the toner grains are susceptible to mechanical and thermal stresses and therefore apt to part from the toner grains or be buried in the same due to repeated agitation in the developing device. Therefore, stresses to act on the developer should be reduced in order to maintain the amount of charge to deposit on the toner grains stable and the durability of the developer. This is also true even when such an additive is not applied to the toner grains.

Today, to meet the increasing demand for the size reduction of a copier or similar image forming apparatus, the size of the developing device is, of course, decreasing. While the size of the developing device may be reduced if the diameter of the photoconductive element and that of the sleeve are reduced, it can also be reduced if the amount of the developer and therefore the size of a developer chamber for storing it is reduced. However, in the case where the amount of the developer is reduced, it is necessary to reduce the amount of the developer not deposited on the sleeve because the developer must be present in the developing zone in a constant amount at all times. In this case, therefore, most part of the developer is deposited on and conveyed by the sleeve at all times and, as a consequence, subject to heavier stress ascribable to the doctor.

Further, for high-speed printing, a force for feeding the developer to the developing zone must be strong enough to maintain high image density. This requirement cannot be met unless the linear velocities of the photoconductive element and sleeve and developer conveying speed are increased, aggravating stresses to act on the developer.

On the other hand, the life of the developing device is determined mainly by the deterioration of the developer, particularly a decrease in the charging ability of the carrier ascribable to repeated development. The charging ability of the carrier decreases because the components of the toner grains locally deposit on the carrier grains. As for oilless toner grains, in particular, wax is dispersed in the toner grains for providing them with a parting ability in the event of fixation. When such toner grains are subject to stress, the resulting heat causes the wax, which is of the same polarity as the toner grains, to exude out of the toner grains and form films on the carrier grains, preventing the carrier grains from charging the toner grains when contacting the toner grains. As a result, the overall amount of charge of the toner grains decreases and brings about toner scattering, background fog and other defects.

Further, the developing device must meet the demand for high image quality, including sharpness, tonality and low granularity, as well as the demand for a long life.

To insure stable, high image quality over a long time with the developing device involving heavy stresses, as stated above, a developing device configured to reduce the stress and long-life carrier grains capable of enhancing image quality have been proposed in various forms in the past, as will be described hereinafter.

Japanese Patent Laid-Open Publication No. 11-161007, for example, discloses a developing device in which a doctor or metering member, facing a sleeve at a preselected gap, is implemented by a magnetic plate configured to form a magnetic field between it and a magnet disposed in the sleeve. The edge of the magnetic plate, facing the sleeve, includes a surface that approaches the sleeve little by little toward the downstream side in the direction of rotation of the sleeve. Such a doctor, according to the above document, stably feeds an adequate amount of developer to the sleeve to thereby reduce stress to act on the developer while reducing a load on a motor assigned to the sleeve. However, the stress to act on the developer does not occur at the edge of the doctor, but occurs mainly in a developer layer intercepted by one major surface or back of the doctor, as will be described more specifically later. The document does not address to the stress occurring in the above developer layer intercepted by the doctor.

Japanese Patent Laid-Open Publication No. 5-35067 teaches a developing device in which a cylindrical, developer conveying member is positioned just upstream of a doctor or metering member and constantly rotated while being spaced from a sleeve by a preselected distance at all times. This document describes that the developer conveying member prevents a developer from being packed in a metering position and does not form a stationary developer layer, which will also be described specifically later, thereby insuring stable image formation free from irregular density. In this developing device, however, a zone where the developer is packed exists between the doctor and the developer conveying member as in a conventional developing device including two doctors or predoctors. It is therefore likely that the developer is packed between the doctor and the developer conveying member when, e.g., the fluidity of the developer varies due to aging or the varying environment, forming a stationary developer layer that deteriorates the developer. Further, the developing device is sophisticated in configuration and therefore high cost.

Japanese Patent Laid-Open Publication No. 9-146374 proposes to position a magnet roller for holding a developer at a position upstream of a doctor and facing a sleeve, thereby reducing stress to act on the developer. The magnet roller, however, increases the amount of the developer, which stays at the position upstream of the doctor, more than when the magnet roller is absent, so that more developer is subject to stress by being held in a developer layer upstream of the doctor. Further, it is likely that stress to act on the individual developer grains increases.

Japanese Patent Laid-Open Publication No. 2001-109266 discloses a method that conveys a desired amount of developer to a developing zone only with magnetic field generating means disposed in a sleeve, thereby obviating stress ascribable to a doctor. Although this method reduces a frictional force and other stresses to act on the developer, toner contained in the developer cannot be sufficiently charged and therefore fails to form a satisfactory image.

On the other hand, to reinforce carrier coating layers, Japanese Patent Laid-Open Publication No. 9-311504 proposes to form hardened coating layers, which are formed of phenol resin containing an amino radical, on the surfaces of spherical, compound core grains made up of ion oxide grain powder and hardened phenol resin. Further, the above document proposes a particular iron oxide grain content and a particular amino radical content. These configurations, according to the document, implement stable frictional charging and durability.

Japanese Patent Laid-Open Publication No. 9-311505 proposes hardened coating layers, which are formed of one or more of melamine resin, aniline resin and urea resin and phenol resin, on the surfaces of spherical, compound core grains for the purpose of implementing stable frictional charging and durability.

Japanese Patent No. 2,825,295 proposes to coat the surfaces of grains, which are formed of ferromagnetic fine grains and hardened phenol resin, with melamine resin, thereby producing magnetic carrier grains with high electric resistance and low bulk density. Also, Japanese Patent No. 2,905,563 implements such carrier grains by uniformly coating the surfaces of grains, which are formed of ferromagnetic fine grains and hardened phenol resin, with polyamide.

Japanese Patent Laid-Open Publication No. 5-273789 proposes to deposit an additive on carrier surfaces while Japanese Patent Laid-Open Publication No. 9-160304 proposes a coating layer containing conductive grains whose size is greater than the thickness of the coating layer. Japanese Patent Laid-Open publication No. 8-6307 proposes a carrier coating material whose major component is a benzoguanamine-n-butylalcohol-formaldehyde copolymer. Also, Japanese Patent No. 2,683,624 proposes a carrier coating layer implemented by crosslinked melamine resin and acrylic resin.

However, considering the current trend toward a lower melting point and a smaller grain size of a toner material that aggravate the adhesion of toner components to carrier surfaces, the prior art schemes described above are not satisfactory in the aspect of a margin as to the adhesion of toner components to carrier surfaces. It is therefore difficult to obviate background fog, toner scattering and other problems, which are ascribable to a decrease in the amount of charge due to aging and lower image quality.

Not only high image quality but also high durability and stability are required of a modern copier, printer or similar image forming apparatus. More specifically, it is necessary to protect image quality from the varying environment and to constantly implement stable images over a long period of time. For example, in the magnet brush type of developing system using the two-ingredient developer, it has been customary to stabilize image density with an alternating electric field that superposes an AC component on a DC voltage to thereby alternately generate an electric field, which biases toner toward a photoconductive element, and an electric field urging the toner toward a sleeve. A high developing ability particular to the alternating electric field insures sufficient solid-image density even when the charge distribution of toner is shifted due to aging. At the same time, there can be generated an electric field strong enough for toner to develop even on a halftone or similar pattern whose latent image is relatively shallow. Such a technology, having the above advantages, is often applied to a color image forming apparatus, among others. Of course, the above technology is optimally applicable even to a monochromatic copier for reducing granularity of a halftone image and forming a uniform solid image.

The alternating electric field, however, brings about discharge due to a local increase in electric field ascribable to the irregular density of the magnet brush in the developing region, particularly in deep portions of a latent image, causing an image to be lost in the form of a ring. Therefore, the resistance of the carrier for development is limited, i.e., it is difficult to use a carrier with low resistance. Furthermore, even when a carrier with medium or high resistance is used, local breakdown ascribable to irregular coating layers occurs and also brings about discharge. In this respect, even the uniformly of carrier coating layers and the resistance of the carrier cores, i.e., the material of the cores are limited.

In light of the above, Japanese Patent Laid-Open Publication No. 2000-29308 proposes a technology for freeing a halftone portion, which adjoins a sold portion, from blur to thereby insure high image quality at all times. In accordance with this technology, the slip efficiency η of a developer relative to the surface of a sleeve is so adjusted as to satisfy a relation:

$$Mb-Ma \geqq 70\text{g/m}^2$$

where Ma denotes the amount of the developer for a unit area, as measured on the sleeve moved away from a doctor or metering member, and Mb denotes the amount of the developer for a unit area on the sleeve in a developing zone.

Further, Japanese Patent Laid-Open Publication Nos. 7-121031 and 7-128982 each propose to position the peak flux density of a main pole for development at a position where a photoconductive element and a sleeve adjoin each other, and to position a pole of opposite polarity having peak flux density within 40° at the upstream side in the direction of rotation of the sleeve. With this configuration, the above document describes that the density of a magnet brush increases to 6/mm$^2$ or above and produces an image free from roughness.

However, in Laid-Open Publication No. 2000-29308 mentioned above, the slip of the developer in the developing zone, i.e., the slip of carrier grains, supporting toner grains, is sometimes undesirable in the aspect of high image quality that should be maintained despite aging. For example, the slip brings about carrier deposition and carrier scattering. Carrier deposition occurs when electric restraint, holding magnetic carrier grains on the sleeve, and electric attraction, acting toward the photoconductive element and derived from a background potential determined by a background potential and bias for development, are brought out of balance. To increase the slip efficiency of the developer for increasing the amount of the developer in the developing zone means to reduce a margin as to the deposition of carrier grains, which originally should be magnetically restrained.

Further, if the slip efficiency and therefore the amount of the developer in the developing zone is excessively increased, then the developer is packed in the upstream and center portions of the developing zone. As a result, a magnet brush rises in the upstream portion and obstructs development that should originally be effected when the magnet brush contacts the photoconductive element. Also, the developer packed in the center portion scrapes off toner grains present on the photoconductive element by scavenging, lowering developing efficiency in the developing zone. As a consequence, the boundary portions of a halftone region around a solid image, particularly a boundary at the upstream side in the direction of development, is lost. As for developing efficiency, the moving speed of the developer right above the sleeve and that of the developer around the photoconductive element should be the same from the efficiency standpoint, so that increasing the slip efficiency η translates into lowering developing efficiency.

Laid-Open Publication Nos. 7-121031 and 7-128982 also mentioned earlier have a problem that the density of the developer or that of the magnet brush in the actual developing zone is determined by a gap for development, the curvature of the photoconductive element and that of the sleeve, i.e., the density of the magnet brush measured on a developing roller differs from the actual system. For example, when an image is formed by the magnet brush having the density of 6/mm$^2$ or above, as measured on a developing roller, and by a large gap for development, roughness is conspicuous in the image.

SUMMARY OF THE INVENTION

It is a first object of the present invention to provide a magnet brush development type of image forming apparatus capable of reducing stress to act on a developer in a developer layer, which stays at a position upstream of a metering member in the direction in which a developer carrier conveys the developer, for thereby insuring stable toner charging and extending the life of the developer.

It is a second object of the present invention to provide toner that does not adhere to carrier grains included in a developer and prevents coating resin thereof from being shaved off.

It is a third object of the present invention to provide a developing device capable of maintaining the chargeability of the above toner stable over a long period of time to thereby obviate background fog and toner scattering against aging, a process cartridge including the same, and an image forming apparatus using the same.

It is a fourth object of the present invention to provide an image forming apparatus capable of maintaining the coating condition of a developer present on a developer carrier optimum before the developer enters a developing zone to thereby optimizing the density of the developer or magnet brush in the developing zone, thereby enhancing the durability of the dot image of a halftone portion and insuring an image with low granularity and high tonality.

It is a fifth object of the present invention to provide an image forming apparatus capable of controlling, while maintaining the coating condition of a developer present on a developer carrier optimum before the developer enters a developing zone, adequately controlling the amount of the developer to pass through the developing zone to thereby improving the durability of the developer and the stability of toner charging.

A developing device of the present invention includes stationary layer angle setting means. Assume that a developer layer, staying at a position upstream of a metering member in a direction in which a developer carrier conveys a developer, consists of a stationary layer in which the developer is not replaced and a flowing layer in which it is replaced, that an angle between, as seen from the axis of the developer carrier, the upstream edge portion, in the above direction, of the end portion of the metering member, which faces the developer carrier, and a position where the end of the stationary layer upstream of, but remote from the edge portion, is located is θd, and that an angle between, as seen from the above axis, the edge portion and a position where a magnetic pole is positioned just upstream of a doctor pole in the above direction is θ1. Then, the angle θd lies in a preselected range relative to the angle θ1.

A process cartridge and an image forming apparatus using the above developing device are also disclosed.

BRIEF DESCRIPTION OF THE DRAWINGS

The above and other objects, features and advantages of the present invention will become more apparent from the following detailed description taken with the accompanying drawings in which:

FIG. 6 is a table listing the results of Experiment 1 conducted with the illustrative embodiment;

FIG. 17 is a table listing various kinds of toner particular to the second embodiment;

FIG. 18 is a table listing the conditions and results of experiments conducted with the second embodiment;

FIG. 22 is a table listing the results of estimation of the apparent coating ratio and the amount of developer conveyed when a carrier has a mean grain size of 55 μm;

FIG. 23 is a table listing the results of estimation of the apparent coating ratio and the amount of developer conveyed when a carrier has a mean grain size of 35 μm; and FIG. 24 is a table listing the results of estimation of the apparent coating ratio and the amount of developer conveyed when a carrier has a mean grain size of 25 μm.

DESCRIPTION OF THE PREFERRED EMBODIMENTS

Preferred embodiments of the present invention will be described hereinafter.

First Embodiment

This embodiment is directed toward the first object stated earlier. To better understand the illustrative embodiment, why a developer is subject to heavy stress due to a doctor or metering member that causes the developer to deposit on a sleeve or developer carrier in a preselected amount will be described first.

Figure 1:
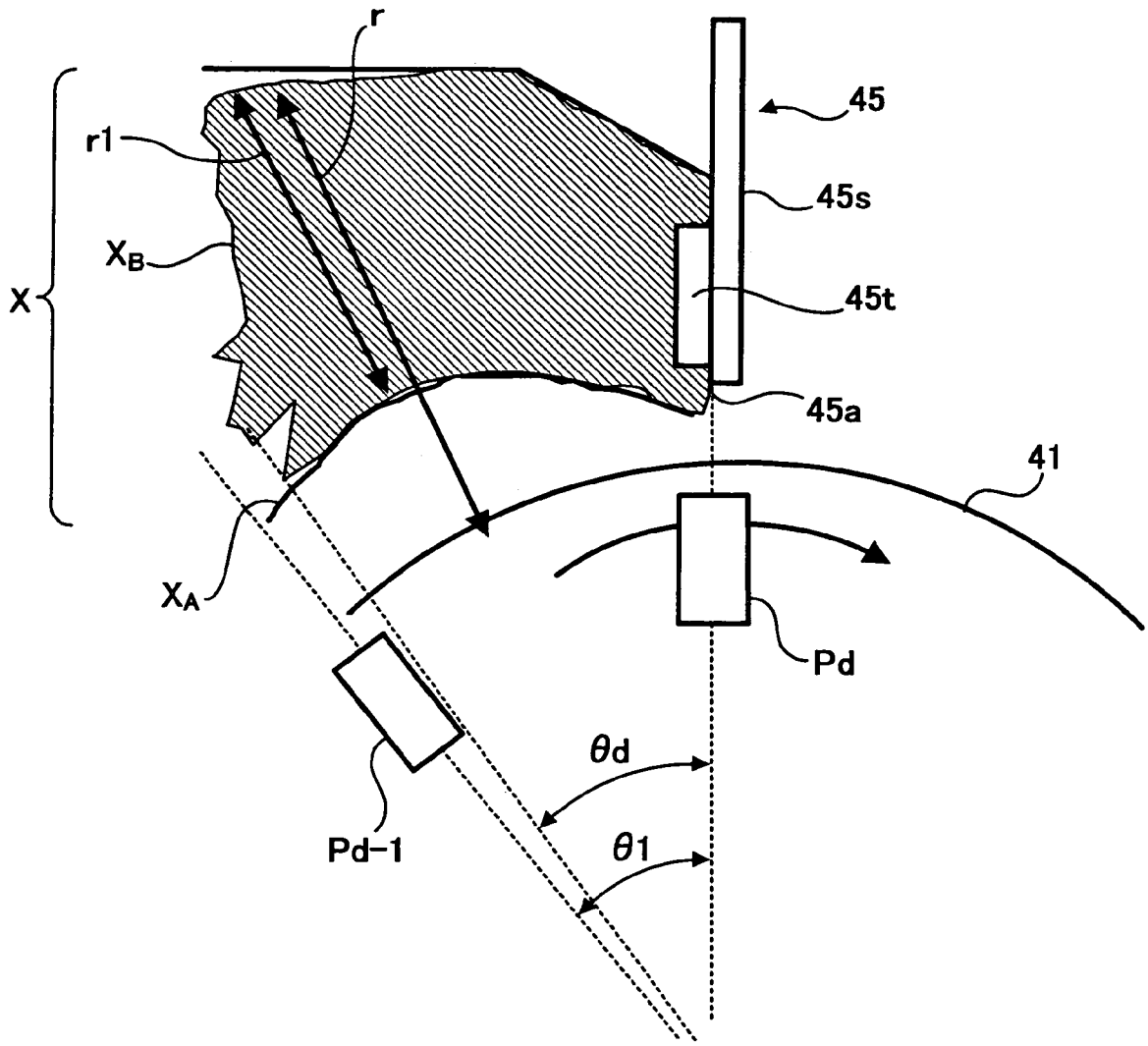
FIG. 1 is a section showing part of a magnet brush development type of image forming apparatus around a doctor gap.

FIG. 1 shows part of a conventional image forming apparatus of the type effecting development with a magnet brush. As shown, a developer deposited on the surface of a sleeve 41 is conveyed by the sleeve 41 to a position upstream of a gap between a doctor 45 and the sleeve 41 in the direction of developer conveyance. The developer is caused to stay at the above position while part of the developer is passed through the gap toward a developing position, not shown, with its thickness being regulated by a doctor edge 45*a* and the sleeve 41. The developer, staying in the vicinity of the doctor 45, forms a developer layer X generally made up of a flowing layer XA and a stationary layer XB. The torque of a developing unit increases in dependence on the configurations and amounts of the flowing and stationary layers XA and XB, exerting stress on the developer. Particularly, part of the developer present in the stationary layer XB is replaced little and is therefore constantly subject to stress. Such stress, acting on the developer layer X, brings about various problems stated previously.

Figure 2:
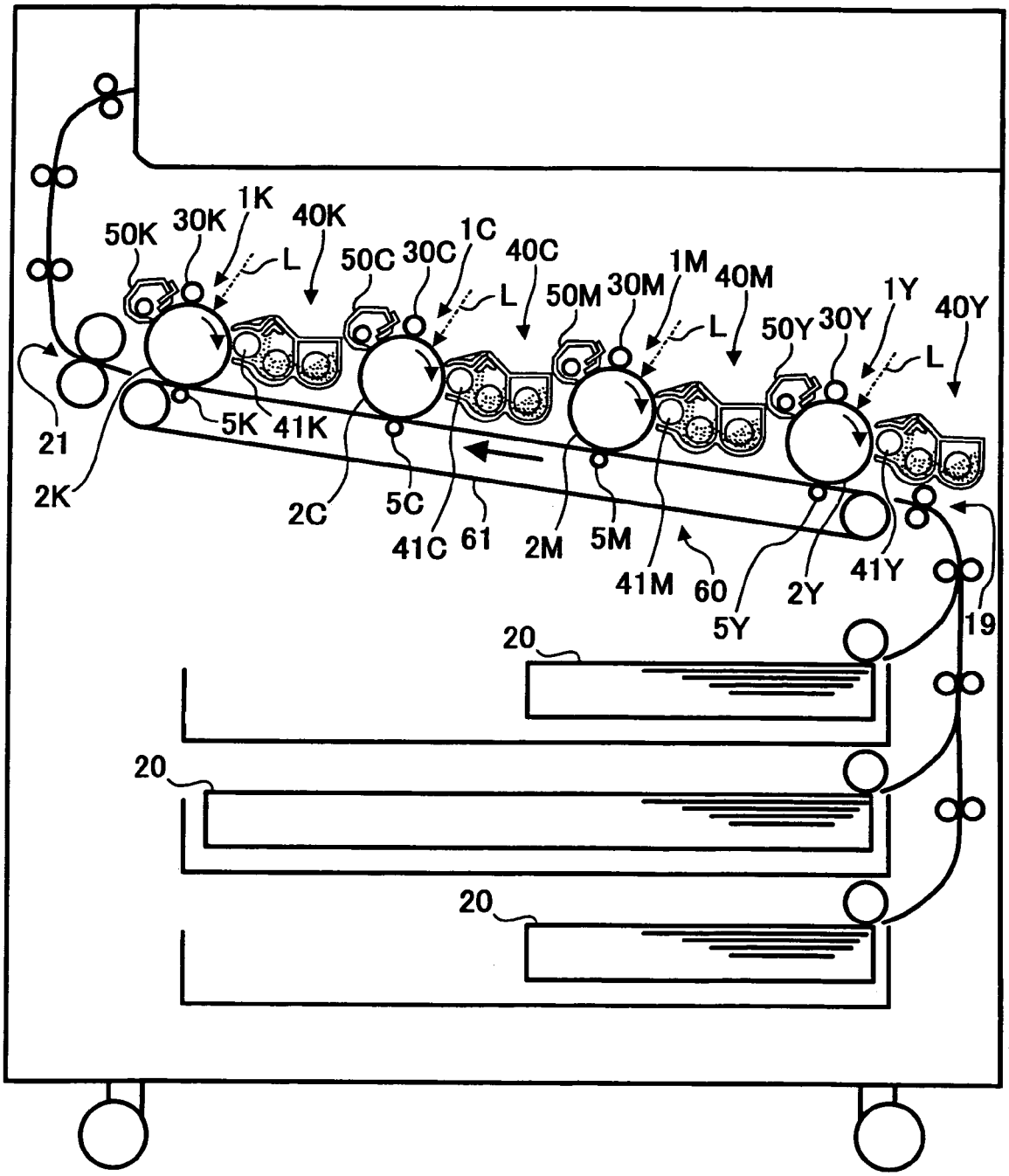
FIG. 2 is a view showing a first embodiment of the image forming apparatus in accordance with the present invention.

Referring to FIG. 2 of the drawings, an image forming apparatus to which the illustrative embodiment is shown and implemented as a tandem, color laser beam printer by way of example. As shown, the printer includes four process units 1Y, 1M, 1C and 1K for forming a yellow (Y), a magenta (M), a cyan (C) and a black (K) toner image, respectively. Also included in the printer are an optical writing unit that emits laser beams L, an image transferring unit 60, a registration roller pair 19, three sheet cassettes 20, and a fixing unit 21.

Figure 3:
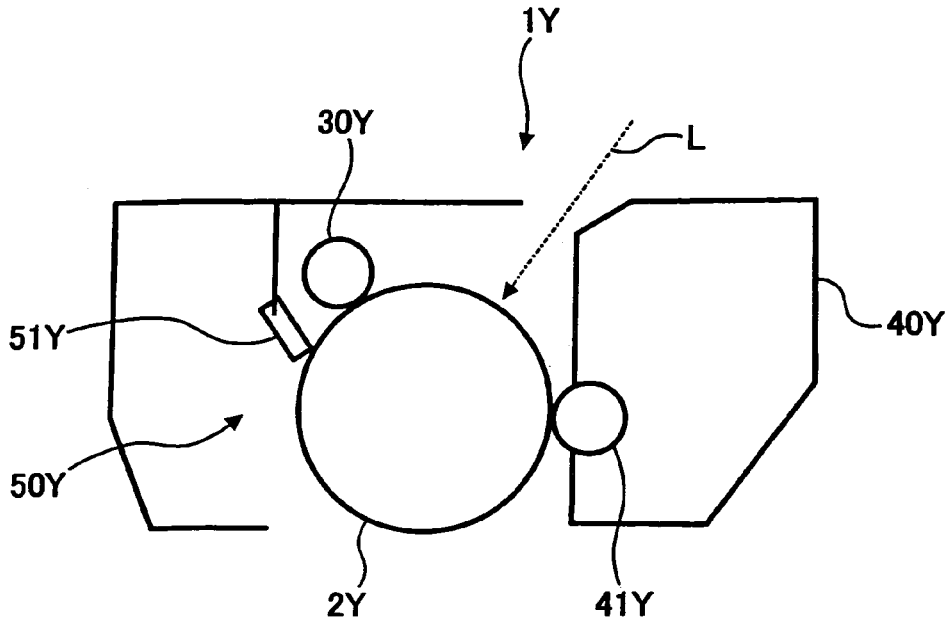
FIG. 3 is an enlarged view showing a yellow process unit included in the illustrative embodiment by way of example.

FIG. 3 shows the configuration of the process unit 1Y by way of example. The other process units 1M, 1C and 1K are identical in configuration with the process unit 1Y. As shown, the process unit 1Y includes a photoconductive drum or similar image carrier (drum hereinafter) 2Y, a charger 30Y, a developing device 40Y, and a cleaning device 50Y.

Figure 4:
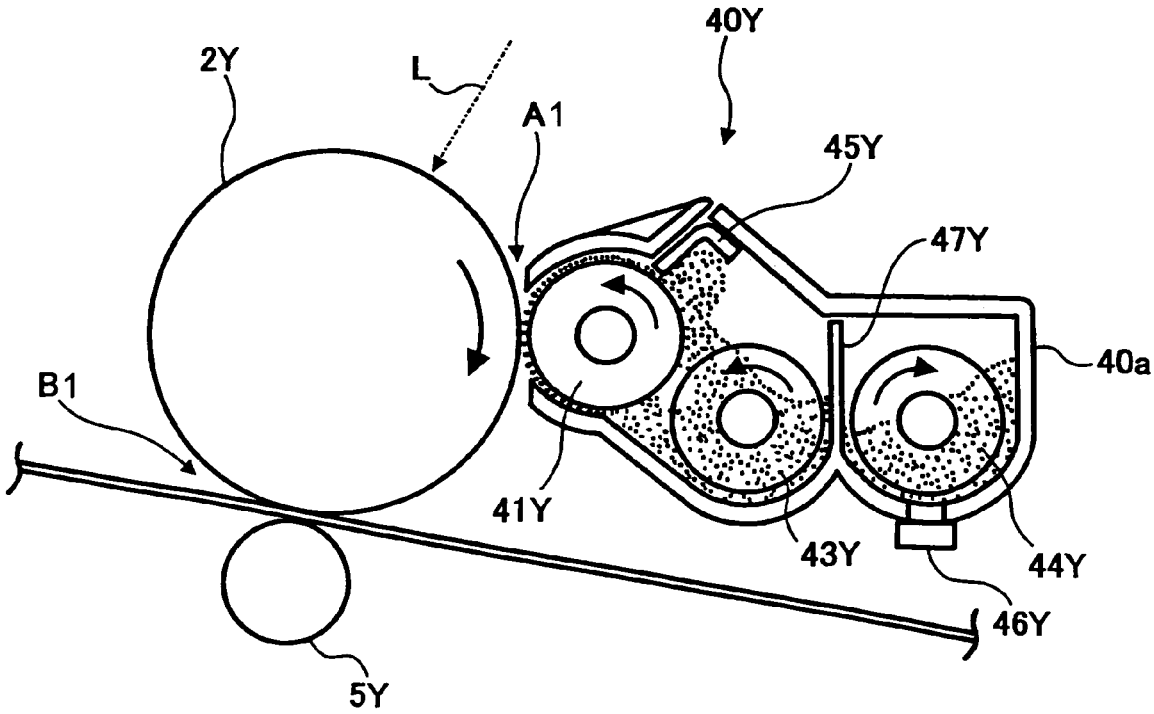
FIG. 4 shows a developing device and a photoconductive drum included in the illustrative embodiment.

FIG. 4 shows the drum 2Y and developing device 40Y together with arrangements therearound. As shown, after the charger 30Y has uniformly charged the surface of the drum 2Y to a preselected positive or negative potential, the laser beam L scans the surface of the drum 2Y imagewise to thereby form a latent image. In the developing device 40Y, a sleeve 41Y in rotation conveys a developer to a nip or developing zone A1 where the sleeve 41Y faces the drum 2Y. As a result, toner included in the developer is deposited on the latent image present on the drum 2Y for thereby producing a corresponding toner image. The toner image thus formed on the drum 2Y is transferred to a sheet or recording medium at an image transfer position B1 where the drum 2Y and an image transfer roller 5Y face each other. The cleaning device 50Y, FIG. 3, removes toner left on the drum 2Y after the image transfer with a cleaning blade S1Y, FIG. 3. Subsequently, a quenching lamp, not shown, discharges the surfaces of the drum 2Y to thereby prepare it for the next image formation.

As shown in FIG. 3, in the illustrative embodiment, two or more of the drum 2, charger 30, developing device 40 and cleaning device 50, constituting each process unit 1, are constructed into a single process cartridge, which is removably mounted to the printer body. In FIG. 3, the entire process unit 1, including the drum 2, charger 30, developing device 40 and cleaning device 50, is implemented as a process cartridge removably mounted to the printer body.

A procedure in which the printer forms a full-color image will be briefly described hereinafter. As shown in FIG. 2, the drums 2Y through 2K are rotated at preselected peripheral speed. By the procedure stated earlier in relation to the developing device 40Y, a toner image of particular color is formed on each of the drums 2Y through 2K. When a sheet is fed from any one of the sheet cassettes 20, FIG. 2, in synchronism with the rotation of the drums 2Y through 2K, the toner images of different colors are sequentially transferred from the drums 2Y through 2K to the sheet one above the other by the image transfer rollers 5Y through 5K respectively facing the drums 2Y through 2K, forming a full-color image on the sheet. The sheet, carrying the full-color image thereon, is separated from the drum 2K and then conveyed to the fixing unit 21 by a belt conveyor 61. After the full-color image has been fixed on the sheet by a pair of fixing rollers included in the fixing unit 21, the sheet is driven out of the printer body.

After the image transfer, the cleaning devices 50Y through 50K remove toner left on the drums 2Y through 2K, respectively, as stated previously.

As stated above, the process cartridges 1Y through 1K are removable from the printer body independently of each other. In the illustrative embodiment, although the life of each drum and the life of each developing device are longer than conventional, they are not always coincident with each other. The illustrative embodiment allows only the process cartridge, including the drum, developing device or the like that should be replaced, to be dismounted from the printer body, so that only the above member or device needing replacement can be removed from the process cartridge and then replaced.

With the above configuration, the illustrative embodiment allows various members and devices to be easily mounted to or dismounted from the printer body, compared to the case wherein such members and devices each are directly positioned on the printer body. Further, only if an abutment member, for example, is used to position the sleeve or similar member relative to the drum in each process cartridge and if a simple mechanism for retracting the former from the latter is provided, the above member can be easily retracted from the drum when development is not effected. This successfully reduces toner filming on the sleeve while extending the life of the developing device and the life of the entire printer.

As shown in FIG. 4, the sleeve or developer carrier 41Y included in the developing device 40Y is partly exposed to the outside via an opening formed in a casing 40*a*. The developing device 40Y additionally includes a first and a second screw 43Y and 44Y, respectively, a doctor or metering member 45Y, and a toner content sensor (T sensor hereinafter) 46Y. The doctor 45Y has an edge facing the surface of the sleeve 41Y via a preselected gap.

The casing 40*a* stores a developer made up of magnetic carrier grains and toner grains chargeable to negative polarity. The developer is conveyed by the first and second screws 43Y and 44Y while frictionally charged by agitation and is then deposited on the sleeve 41Y in the form of a magnet brush by a magnetic pole, which is disposed in the sleeve 41Y. Subsequently, the developer is metered by the doctor 45Y and then conveyed to the developing zone A1 where the sleeve 41Y faces the drum 2Y. In the developing zone A1, the developer, forming a magnet brush on the sleeve 41Y, is brought into contact with the surface of the drum 2Y. At this instant, the toner grains are deposited on the latent image present on the drum 2Y by an electric field for development, which will be described later, producing a Y toner image on the drum 2Y. The developer thus released the toner grains and is returned to the casing 40*a* by the sleeve 41Y.

A partition 47Y, existing between the first and second screws 43Y and 44Y, divides the inside of the casing 40*a* into a first chamber or feeding section, which accommodate the sleeve 41Y and first screw 43Y, and a second chamber or feeding section accommodating the second screw 44Y. Drive means, not shown, causes the first screw to rotate 43Y and convey the developer from the front toward the rear of the first chamber, as seen in a direction perpendicular to the sheet surface of FIG. 4, while feeding it to the sleeve 41Y. The developer thus conveyed to the end portion of the first chamber is introduced into the second chamber via an opening, not shown, formed in the partition 47Y. In the second chamber, the second screw 44Y, driven by drive means not shown, conveys the developer fed from the first chamber in the opposite direction to the first screw 43Y. The developer so conveyed to the end portion of the second chamber is returned to the first chamber via an opening, not shown, also formed in the partition 47Y.

The T sensor 46Y, implemented by a permeability sensor, is mounted on the bottom of the casing 40*a* at the center portion of the second chamber so as to output a voltage corresponding to the permeability of the developer, which moves above the T sensor 46Y. More specifically, the permeability of the developer is related to the toner content of the developer to a certain extent, so that the output voltage of the T sensor 4 6Y corresponds to the toner content. The output voltage of the T sensor 46Y is sent to a controller not shown. The controller includes a RAM (Random Access Memory) storing a target value Vtref to which the sensor output should be controlled. The target value Vtref is used to control the drive of a Y toner conveying device not shown, so that the Y toner content of the developer present in the developing device 40Y is confined in a preselected range. This is also true with the developing devices of the other process units.

Hereinafter will be described how the illustrative embodiment reduces stresses to act on the developer layer X, FIG. 1, in order to enhance stable charging of the toner and durability of the developer. Briefly, the illustrative embodiment maintains the condition of the developer layer X, which stays at the position upstream of the doctor, adequate for thereby freeing the developer layer X from an excessive frictional force.

First, a specific method of determining the condition of the developer layer X and the conditions of the stationary layer XB and flowing layer XA in the developer layer X will be described. After only a carrier has been introduced into the developing device, the developing device is caused to start operating, and then a toner begins to be fed. As soon as the toner content on the sleeve 41 and screws 43 and 44 reaches a preselected content, the developing device is caused to stop operating. At this instant, while the toner content of the flowing layer XA becomes as high as the toner content on the screws 43 and 44, the toner content of the stationary layer XB remains at 0 wt % to 0.05 wt % or below.

After the toner content on the screws 43 and 44 has reached the preselected value, the sectional image of the developer layer X is picked up and then digitized on the basis of lightness. The resulting digital data are used to analyze the sectional shape of the developer layer X by quantization. With this method, it is possible to separate the flowing layer XA and stationary layer XB. We used a stereoscopic microscope SZ-STB1 (trade name) available from OLYMPUS OPTICAL CO., LTD. for actual estimation and used image processing software for digitization. With such processing, it is possible to determine whether or not the stationary layer XB is present in the developer layer X as well as the thickness of the developer layer X and that of the stationary layer XB. Alternatively, use may be made of, e.g., a high-speed camera for directly observing the section of the developer layer X.

[Experiment 1]

By using the above method, we conducted Experiment 1 for determining a relation between the condition of the developer layer X and torque acting on the developing device. As shown in FIG. 1, assume a stationary layer angle θd between the doctor edge 45*a* and the end of the stationary layer XB upstream of, but remote from, the doctor edge 45*a*. Also, assume an inter-pole angle θ1 between a doctor pole P8, see FIG. 5, (or $P_d$ in FIG. 1) and the peak flux density position of an upstream pole P7, ($P_{d-1}$ in FIG. 1) which adjoins the doctor pole P8 in the direction of developer conveyance, in the normal direction. By varying the stationary layer angle θd and inter-pole angle θ1, we measured the dynamic torque, kgf.cm, of the developing device.

Figure 5:
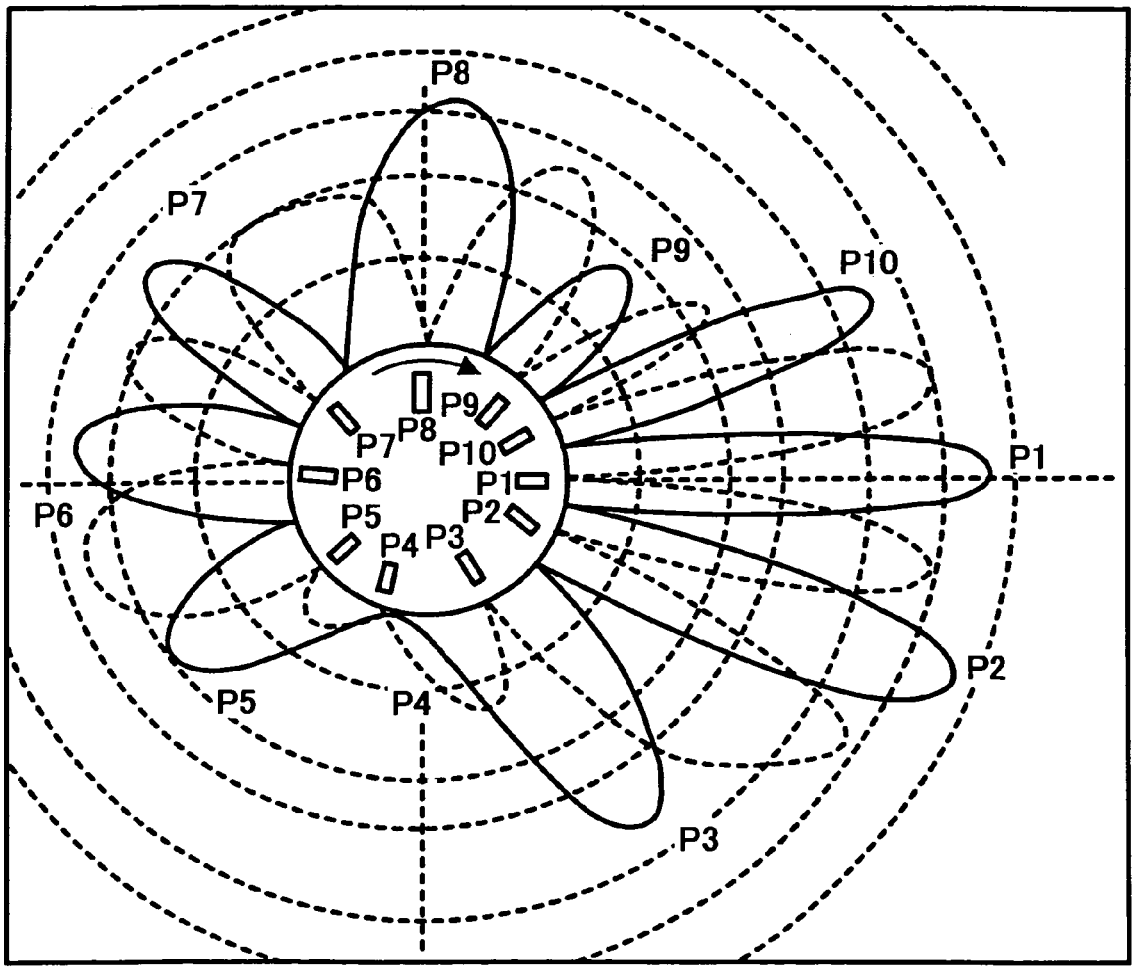
FIG. 5 is a chart showing flux density distributions formed in the normal and tangential directions by the magnetic poles of a magnet roller disposed in a sleeve, which is included in the developing device of FIG. 4.

Before a method of varying the stationary layer angle θd, there will be described magnetic poles fixed in place within the sleeve 41 with reference to FIG. 5. FIG. 5 shows a magnet roller disposed in the sleeve 41 and provided with magentic poles; solid lines and phantom lines indicate flux density distributions in the normal direction and tangential direction, respectively. The doctor pole P8 mentioned earlier is located at a position where the flux density in the normal direction has a peak value. A pole P7 and poles P6 and P5 are sequentially arranged toward the upstream side in the direction in which the sleeve surface moves; the pole P5 serves to magnetically scoop up the developer onto the sleeve surface. Further, poles P4, P3, P2 and P1 are sequentially arranged toward the upstream side in the direction of movement of the sleeve surface; the pole P1 is a developing pole facing the drum. In addition, poles P10 and P9 are sequentially arranged toward the upstream side in the above direction. The magnet roller therefore has ten poles in total.

In the above arrangement, the poles P6 and P7 intervene between the scoop-up pole P5 and the doctor pole P8 in the direction of movement of the sleeve surface and serve to convey the developer, which is scooped up by the pole P5, to the doctor gap. Therefore, it is possible to easily control the amount of the developer to be conveyed to the doctor gap on the basis of the flux densities of the poles P6 and P7.

By contrast, assume that use is made of a magnet roller lacking the poles P6 and P7 between the scoop-up pole P5 and the doctor pole P8. Then, when the amount of the developer deposited on the sleeve should be reduced, it is necessary to reduce the flux density of the scoop-up pole P5. This brings about a problem that when the fluidity or the bulk density of the developer varies due to repeated operation, the amount of the developer to move toward the sleeve is apt to become unstable, requiring the gap between the screw and the sleeve to be reduced or the volume of the developer itself to be increased.

In the illustrative embodiment with the magnet roller of FIG. 5, the stationary layer angle θd was varied mainly by varying the flux density of the doctor pole P8 and that of the pole P7 adjoining it at the upstream side. More specifically, FIG. 6 is a table including a standard condition 1, a condition 2 in which the flux density of the pole P7 in the normal direction was reduced by 20 mT, a condition 3 in which the flux density of the pole P6 in the normal direction was reduced by 20 mT, and a condition 4 in which only the upstream portion of the flux density of the doctor pole P8 in the direction of sleeve rotation was reduced.

Figure 7:
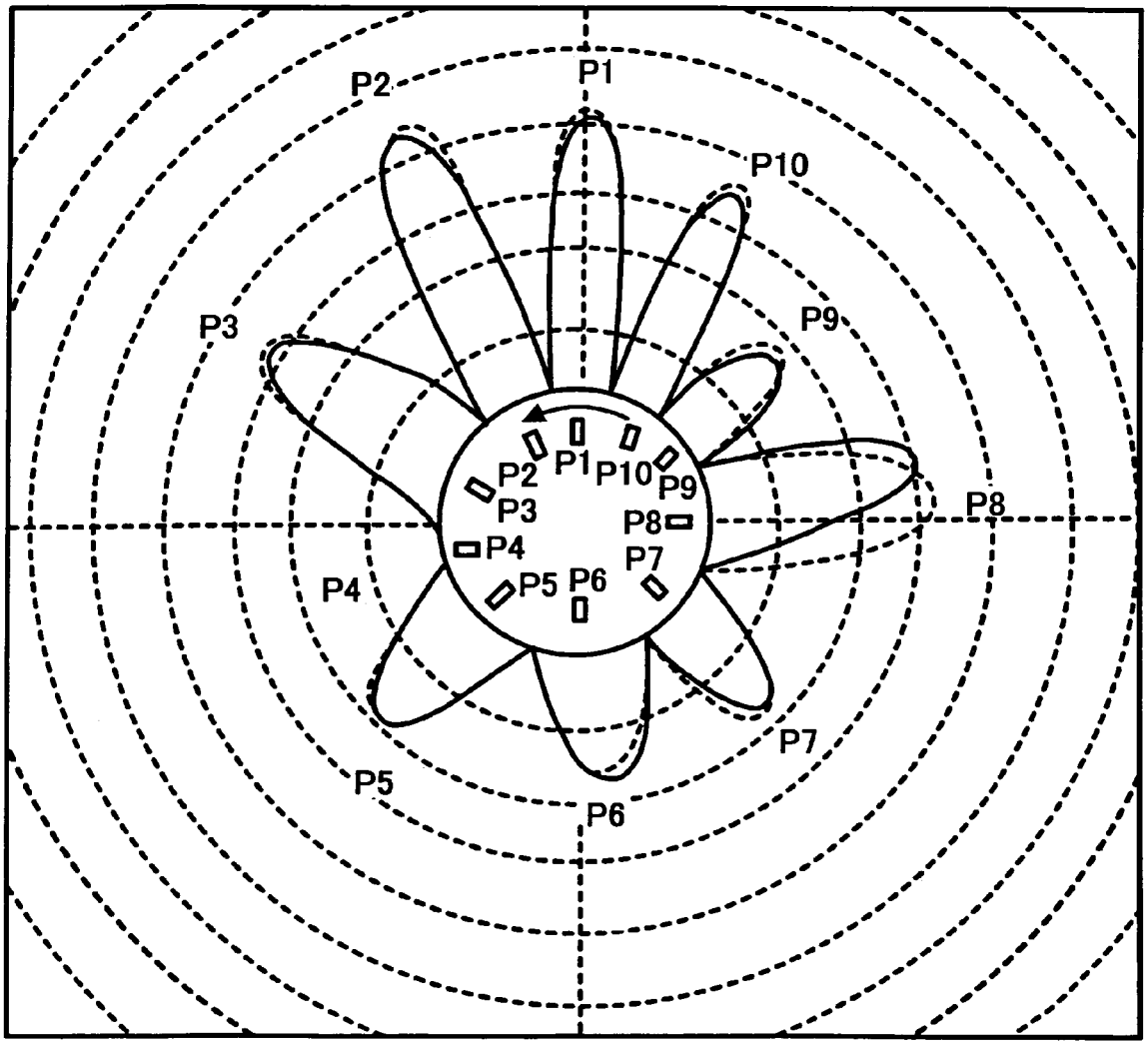
FIG. 7 is a chart comparing conditions 1 and 4 by using flux densities in the normal direction.

FIG. 7 compares the conditions 1 and 4 as to the flux density distributions of the magnet roller in the normal direction; phantom lines and solid lines relate to the conditions 1 and 4, respectively. As for the condition 4, among magnets provided on the magnet roller, the magnet or doctor pole P8, originally having a width of 6.6 mm and a height of 5.5 mm, was replaced with a magnet having a width of 4 mm and a height of 7.5 mm. A condition 5 also shown in FIG. 6, is the combination of the conditions 2 through 4.

The amount of the developer upstream of the doctor pole P8 may be controlled by increasing the angle between the doctor edge and the conveying pole upstream of the same or by reducing the peak flux density of the scoop-up pole, if desired. However, this kind of scheme is apt to aggravate irregularity in the amount of the developer upstream of the doctor pole. In the illustrative embodiment, the angle between the doctor and the pole upstream of the doctor is selected to be 45° or less.

Further, while the peak flux density of the doctor pole P8 in the normal direction itself may be lowered, this scheme, in due course, reduces the amount of the developer to be conveyed to the developing zone via the doctor gap although capable of reducing the dynamic torque. Moreover, the decrease in the amount of the developer to reach the developing zone becomes noticeable after repeated operation, making image quality unstable. In addition, the charging of the toner is obstructed at the doctor due to a short conveying force.

To measure a dynamic torque, only the sleeve, carrying the developer thereon, was rotated. This allows minute torque variation to be measured without being effected by noise ascribable to the screws. More specifically, a dynamic torque was measured by monitoring the output of a strain gauge available from KYOWA DENGYO with a data logger for 20 seconds and using a mean dynamic torque as a representative.

FIG. 6, showing the results of Experiment, lists inter-pole angles θ1, stationary layer angles θd and ratios θd/θ1 thereof in various conditions different in the angles θ1 and θd from each other. As shown, in conditions 1 through 5, the inter-pole angle θ1 was selected to be 45°. In conditions 6 through 10, while the flux densities of the poles were the same as in the conditions 1 through 5, the inter-pole angle θ1 was selected to be 30° and the stationary layer angle θd was varied.

Analysis based on the data of FIG. 6 showed that the smaller the ratio θd/θ1, the smaller the dynamic torque, and vice versa. This indicates that for a given inter-pole angle θ1, a positive correlation holds between the stationary layer angle θd and the dynamic torque. It follows that by reducing the stationary layer angle θd, it is possible to reduce the dynamic torque and therefore the stress to act on the developer.

Figure 8:
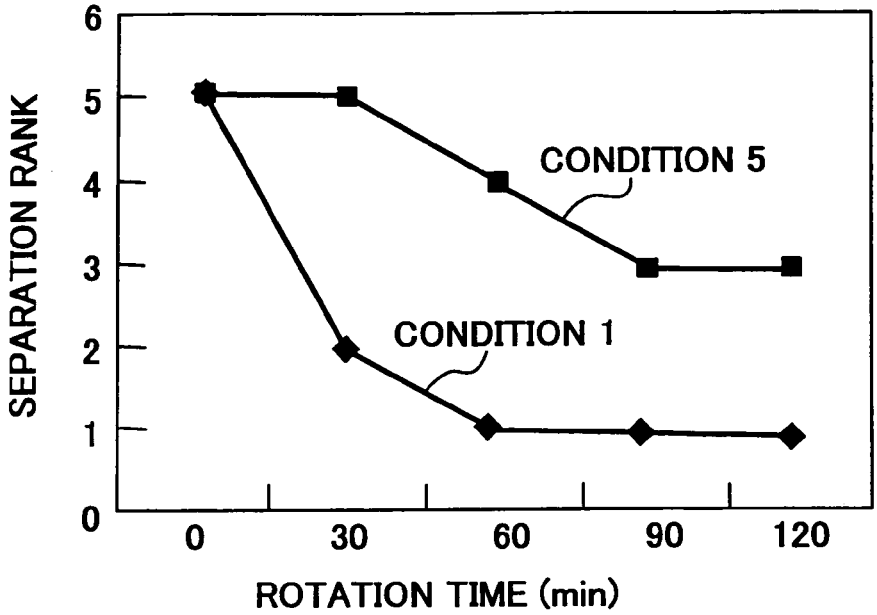
FIG. 8 is a graph comparing conditions 1 and 5 as to the separation of additives from toner surfaces with respect to the duration of sleeve rotation.

Next, we compared, among the conditions 1 through 10, the conditions 1 and 5 as to the variation of the amount of additives parted from toner grains with respect to time and how the carrier charging ability CA, −μc/g, varied. FIG. 8 shows the amounts of additives parted from toner grains in the conditions 1 and 5 and estimated in ranks 1 through 6. The amount of such additives was determined by observing the surface conditions of toner grains with a scanning electronic microscope (SEM). Rank 5 shows the initial condition of additives present on toner grains. Rank 1 shows a condition in which additives were not found on toner grains at all while rank 3 shows a condition in which about one-half of additives parted from toner grains. More specifically, a test machine loaded only with a developing device was operated alone in each of the conditions 1 and 5 for plotting the profile of lowering of the rank up to 120 minutes. Background contamination does not occur in the event of replenishment if the rank is 3 or above, but occurs if the rank is 2 or below. It is therefore necessary to satisfy the rank 3 or above throughout repeated operation.

Figure 9:
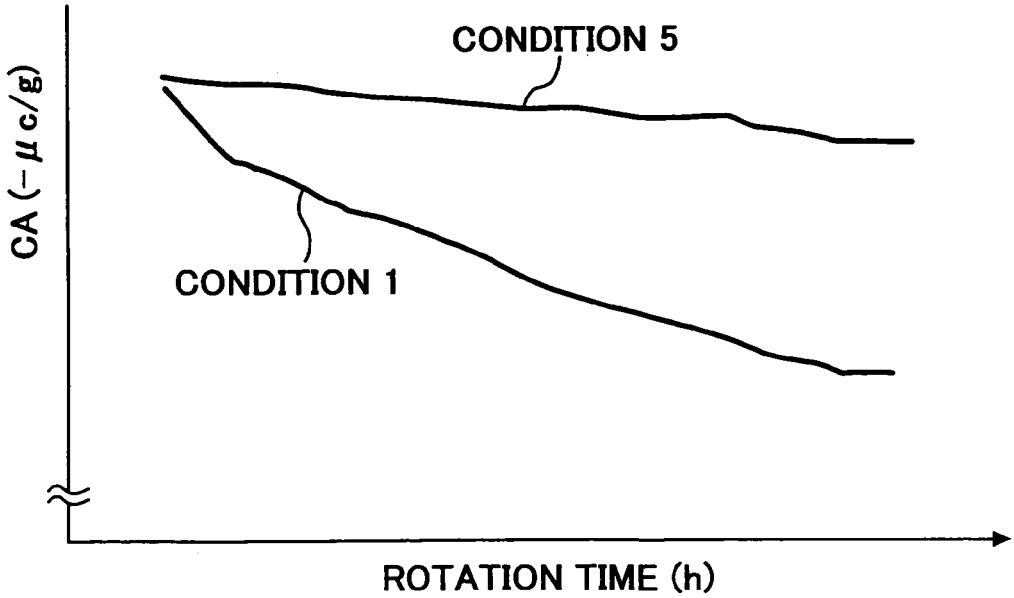
FIG. 9 is a graph comparing the conditions 1 and 5 as to the variation of a carrier charging ability CA with respect to time.

FIG. 9 compares the conditions 1 and 5 as to how the carrier charging ability CA varied with respect to time. For the measurement, the same machine with the developing device was operated to constantly consume toner such that the area ratio of the output image was 5%. At the same time, toner was replenished in a constant amount for maintaining the toner content in the developing device constant. The test was continued for 40 hours. As for the carrier charging ability CA, the amount of charge was measured after ejecting the toner from the developer, mixing fresh toner with the developer and then agitating the developer with a roll mill. The ratio of decrease of CA with respect to time should preferably be 10% or below; otherwise, toner scattering and background contamination would occur during repeated operation, lowering reliability.

It is to be noted that the estimation shown in FIG. 8 gives priority to the deterioration of toner while the estimation shown in FIG. 9 gives priority to the degree of degradation of carrier. Toner grains used for the experiment and measurement described above were polymerized spherical toner grains having mean circularity of 0.98 and a volume-mean grain size of 5.2 μm while carrier grains included Mn—Fe (manganese-iron) cores and had a volume-mean grain size of 35 μm.

The data shown in FIGS. 6, 8 and 9 indicate the following.

As shown in FIG. 8, the amount of additives parted from toner grains with respect to the duration of sleeve rotation is noticeably different between the conditions 1 and 5. More specifically, in the condition 1, the rank dropped to 2, which was not acceptable, in 30 minutes and then further dropped to 1. By contrast, in the condition 5, rank 3 was maintained even in 120 minutes. Rank 3 can be maintained even in 120 minutes in, among the conditions listed in FIG. 6, the conditions 4, 5 and 10.

As shown in FIG. 9, the variation of the carrier charging ability CA with respect to the duration of sleeve rotation also noticeably varies from the condition 1 to the condition 5. More specifically, the ability CA dropped by 10% or more in 10 hours in the condition 1, but did not drop by 10% even in 40 hours in the condition 5.

It will be seen from the above that if the ratio θd/θ1 is 1/3 or less, then the amount of additives to part from toner grains and carrier charging ability both are satisfactory. For Experiment 1, use was made of a sleeve having a diameter of 25 mm. Although the sleeve diameter smaller than 25 mm may be used, the absolute value of a dynamic torque decreases with the sleeve diameter. Therefore, so long as the ratio θd/θ1 is 1/3 or less, there is no fear that each item of estimation, belonging to an acceptable rank, drops to an unacceptable rank. In the illustrative embodiment, the flux density of the pole disposed in the sleeve is varied as stationary layer angle setting means for setting the ratio θd/θ1 of 1/3 or below.

Figure 10:
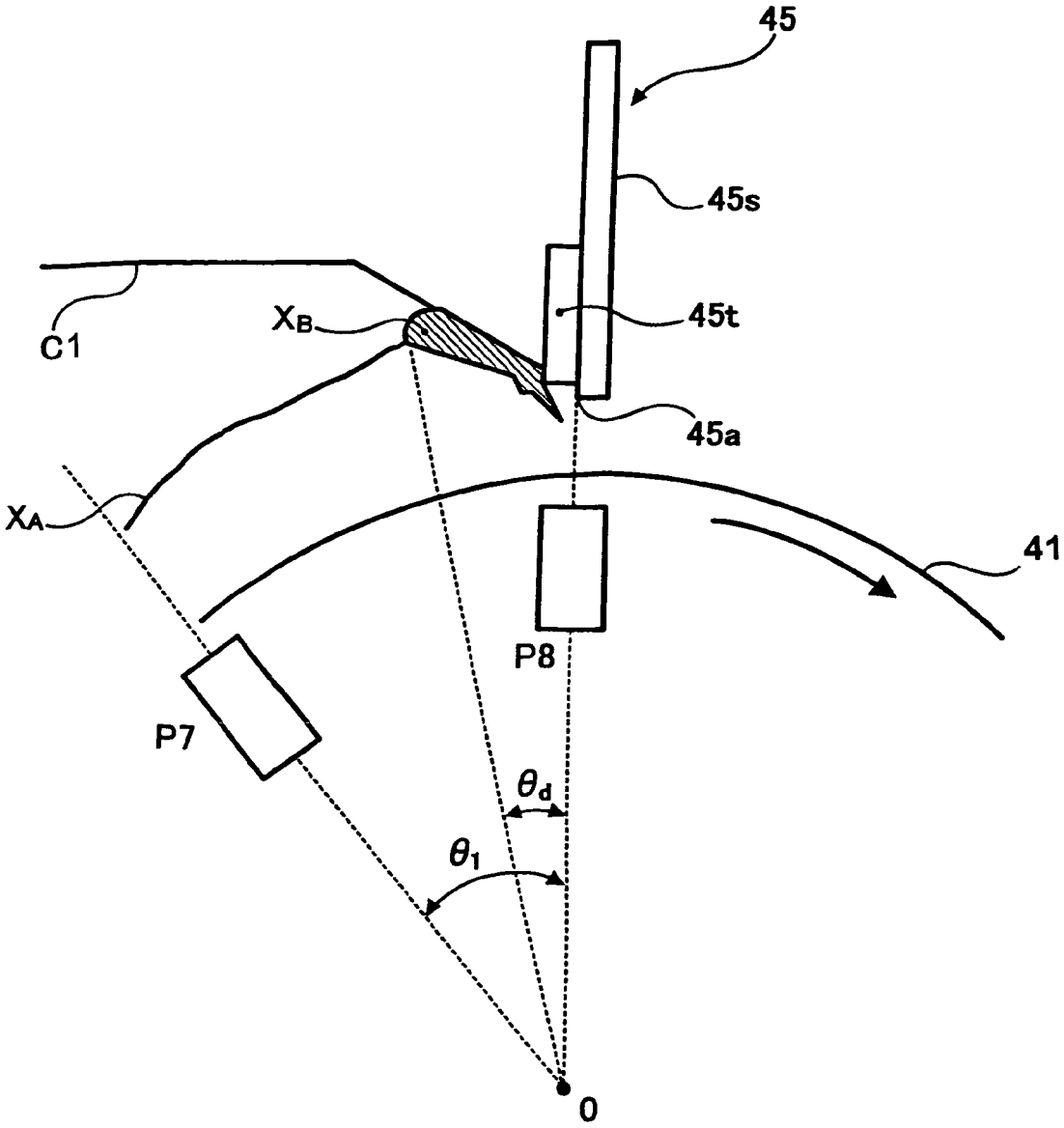
FIG. 10 shows a portion around a developer layer representative of a specific example of the illustrative embodiment.

FIG. 10 shows Example 1 of the illustrative embodiment in which the ratio θd/θ1 is selected to be 1/3 or below. As shown, the flux densities of the poles in the normal direction are varied in such a manner as to prevent the range of the stationary layer XB upstream of the doctor 45 from being excessively extending, thereby implementing the above ratio θd/θ1. It is to be noted that when the poles P7 and P6 for conveyance upstream of the doctor pole P8 are absent, the inter-pole angle θ1 is an angle between the doctor pole P8 and any pole just upstream of the doctor pole P8.

The doctor 45 is made up of a nonmagnetic blade 45*s* and a magnetic member 45*t* adhered to the blade 45*s*. The doctor 45 with such a configuration is located at a position where the magnetic field of the doctor pole P8 has a peak value. In this condition, the magnetic member 45*t* is charged to opposite polarity to the doctor pole P8 to thereby generate magnetic lines of force, allowing the developer to easily form a magnet brush. This successfully stabilizes the amount of the developer to pass the doctor gap against the varying amount of the developer upstream of the doctor 45.

Further, a nonmagnetic casing C1 covers the magnetic member 45*t* except for the portion of the magnetic member 45*t* adjoining the surface of the sleeve, i.e., covers the upper end portion of the magnetic member 45*t* remote from the sleeve surface. The height of the flowing layer XA, as measured in the radial direction of the sleeve, decreases toward the doctor gap little by little while the height of the stationary layer XB increases little by little, as observed in the section of the developer layer X. When the upper end portion of the magnetic member 45*t* is not covered with a nonmagnetic member, a leak flux is generated from the upper end portion and tends to hold a more than necessary amount of developer in the vicinity of the doctor 45. As a result, the stationary layer XB increases in size and obstructs torque reduction. Further, to efficiently use the magnetic doctor, the magnetic field should preferably concentrate on the edge of the doctor 45.

Figure 11:
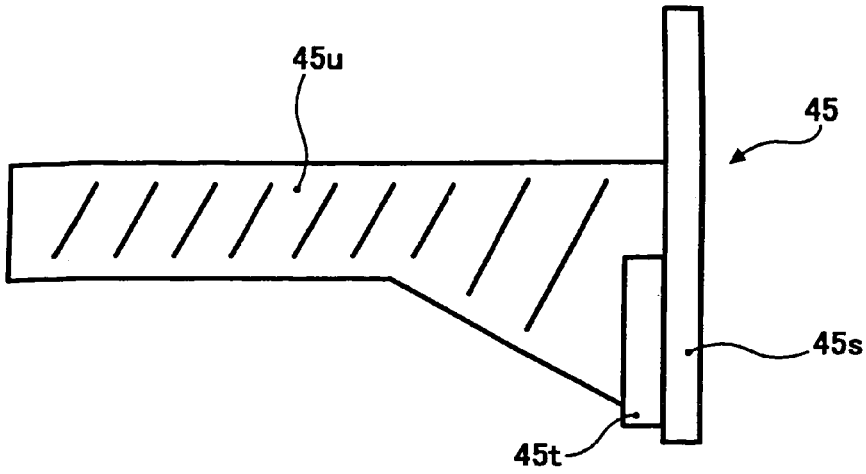
FIG. 11 shows a specific configuration of a doctor included in the illustrative embodiment and in which the upper portion of a magnetic member is buried in a nonmagnetic member.

As shown in FIG. 11, the casing C1, constituting a nonmagnetic member that covers the upper end portion of the magnetic member 45*t*, may be replaced with a member 45*u* in which the upper portion is buried, if desired.

In the illustrative embodiment, use is made of polymerized spherical toner produced by the following procedure. First, an oleaginous dispersion is prepared at least by dissolving a polyester-based prepolymer A, which belongs to a family of polyester resins containing isocyanate radicals, in an organic solvent, dispersing a pigment-based colorant in the solvent, and dissolving or dispersing a parting agent in the solvent. The oleaginous dispersion thus prepared is dispersed in a water-based solvent in the presence of inorganic fine grains and/or fine polymer grains. Subsequently, the prepolymer A mentioned above is caused to react with monoamine B, which contains polyamine and/or a radical containing active hydrogen, in the above dispersion, forming urea-modified polyester-based resin C containing a urea radical. Finally, the liquid medium is removed from the dispersion containing the urea-modified polyester-based resin C. In short, the toner contains binder resin implemented by the urea-modified polyester resin C increased in molecular weight by the reaction of the prepolymer A and amine B. The colorant is densely dispersed in such a binder resin.

As for color toner for electrophotography containing at least binder resin, a parting agent non-soluble in the binder resin and a colorant, it is possible to cause the binder resin and colorant to initially, sufficiently adhere to each other by kneading a binder resin and colorant mixture together with an organic solvent beforehand. This establishes a condition that promotes effective dispersion, i.e., desirably disperses the colorant in the binder resin to thereby reduce the dispersion diameter of the colorant and disperse the colorant, enhances the coloring ability of the colorant, and provides the toner with clear color and high permeability.

The urea-modified polyester resin C has a glass transition temperature Tg of 40° to 65°, preferably 45° to 60°, a number-mean molecular weight Mn of 2,500 to 50,000, preferably 2,500 to 30,000, and a weight-mean molecular weight Mn of 10,000 to 500,000, preferably 30,000 to 100,000.

In the illustrative embodiment, the toner has a weight-mean grain size Dv of 4 μm to 8 μm. The ratio of the grain size Dv to the number-mean grain size Dn of the toner, i.e., Dv/Dn is selected to lie in the range of $1.00 \leqq Dv/dn \leqq 1.25$. With such a ratio Dv/Dn, it is possible to attain toner implementing high resolution and high image quality. To achieve high-quality images, it is preferable to limit grains with grain sizes of 3 μm and below to 1 number % to 10 number percent under the above conditions. Further, the weight-mean grain size should preferably be between 4 μm and 6 μm while the ratio Dv/Dn should preferably lie in the range of $1.00 \leqq Dv/Dn \leqq 1.15$.

In the illustrative embodiment, the toner has mean circularity of 0.90 or above, but less than 1.00. Circularity is measured by use of a flow type particle image analyzer FPIA-2000 (trade name) available from SYSMEX and is produced by dividing the circumferential length of a circle identical in area with the projected area of a toner grain by the circumferential length of the projected image. It is important that toner be provided with a particular shape and a particular shape distribution. Toner with mean circularity of less than 0.90 has an amorphous shape and cannot implement satisfactory image transfer or high-quality images. More specifically, amorphous toner grains each contact the drum or similar smooth medium at many points while causing charges to concentrate on the tips of projections, so that a Van der Waals force and a mirror image force are higher than in the case of relatively spherical toner grains. Consequently, as for toner including both of amorphous grains and spherical grains, the spherical grains selectively move at the time of electrostatic image transfer, causing characters or lines to be lost. Further, the toner left after image transfer must be removed before the next development, resulting in the need for a cleaner as well as in low toner yield.

By contrast, toner grains with mean circularity of 0.90 or above, but below 1.00, has high fluidity and can be well dispersed when replenished and can be rapidly charged. In addition, such toner non-electrostatically adheres to a photoconductive element little and therefore realizes development free from irregularity and efficient, desirable image transfer.

Pulverized toner, as distinguished from the polymerized toner used in the illustrative embodiment, usually has circularity of 0.910 to 0.920, as measured by the analyzer mentioned earlier. In this respect, the polymerized toner may be replaced with pulverized toner, if desired. Also, to produce spherical toner with high mean circularity, the method stated previously may, of course, be replaced with emulsification polymerization, suspension polymerization, dispersion polymerization or similar polymerization.

Additives added to the surfaces of toner grains comprise 0.7 part by weight of silica and 0.3 part by weight of titanium oxide. To further increase developing efficiency by reducing physical adhesion of carrier grains and toner grains, 1 part by weight or more of silica may be added to the surfaces of toner grains for thereby enhancing the fluidity of toner grains. This, however, reduces a margin as to the variation of environment ascribable to the variation of the amount of charge and reduces the amount of carrier grains to be scooped up, i.e., the amount of carrier grains to pass through the doctor gap for a unit area during repeated operation.

In the illustrative embodiment, the magnetic carrier grains are provided with a volume-mean grain size of 25 μm or above, but 55 μm or below.

The illustrative embodiment effects negative-to-positive development by uniformly charging the drum or photoconductive element to a potential VD of −350 V, establishing a potential VL of −50 V after development and applying a bias VB of −250 V for development, i.e., with a developing potential of VL−VB=200 V. Further, there holds a relation of $$0V < |VD| - |VB| < |VD - VL| < 400V; |VD - VL| < 400V$$

is selected on the basis of Paschen's law in order to obviate discharge in the exposed and non-exposed portions.

[Experiment 2]

The thickness of the stationary layer XB in the radial direction of the sleeve was varied in each of the conventional printer and illustrative embodiment in order to determine how the carrier charging ability CA varied in accordance with the number of sheets output. Experiment 2 differs from Experiment 1 in that the thickness of the stationary layer XB was varied by varying the clearance or distance between the sleeve and the casing C1 of the developing device.

Figure 12A:
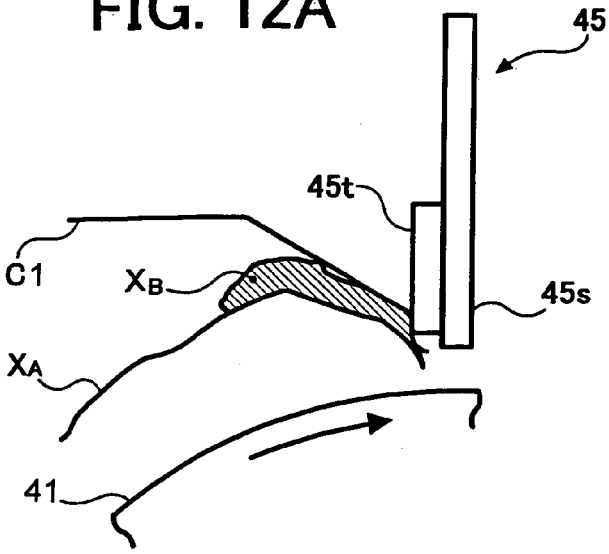
FIGS. 12A and 12B each show a particular clearance between the sleeve and a casing.
Figure 12B:
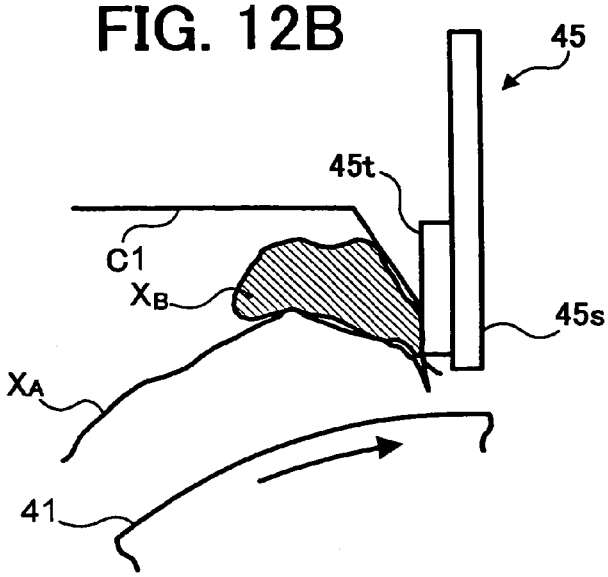

FIGS. 12A and 12B each show a particular condition of the stationary layer XB dependent on the clearance between the sleeve 41 and the casing C1 (casing clearance hereinafter). As shown in FIG. 12A, when the casing C1 is gently inclined relative to the surface of the sleeve 41 upstream of the doctor 45 such that it leaves the above surface little by little over a substantial distance, the stationary layer XB is thin. By contrast, as shown in FIG. 12B, when the casing C1 is sharply inclined relative to the surface of the sleeve 41 such that it sharply leaves the above surface, the stationary layer XB is thick. In this manner, the casing clearance effects the thickness of the stationary layer XB. It is therefore possible to adjust the thickness of the stationary layer XB by varying the casing clearance.

It is to be noted that the above adjustment of the stationary layer XB using the casing clearance is applicable only to the conditions 4, 5 and 10 of Experiment 1 in which the torque is relatively low. In the other conditions, the torque on the sleeve surface and therefore the stress to act on the developer would noticeably increase, preventing the expected effect from being achieved. This is because if the casing clearance is reduced to reduce the thickness of the stationary layer XB, then the developer is forcibly packed in the narrow clearance, resulting in an increase in torque. Consequently, when the ability to hold the developer at the position upstream of the doctor 45 is high, i.e., when the conveying force is strong, a decrease in casing clearance results in a noticeable increase in torque and therefore an increase in stress to act on the developer.

As shown in FIG. 1, assume that the maximum thickness of the developer layer X in the radial direction of the sleeve is r, and that the maximum thickness of the stationary layer XB in the above direction is r1. The carrier charging ability CA, −μc/g, was varied to estimate the stability of toner charging dependent on the variation of environment. For the estimation, use was made of a developer with unsaturated charge prepared by mixing fresh carrier grains and fresh toner grains with a turbular mixture for 1 minute or so. With such an unsaturated toner, it is possible to estimate the stability of charging on the basis of the condition in which the developer is conveyed via the doctor, i.e., on the basis of stress.

Figures 13, 14:
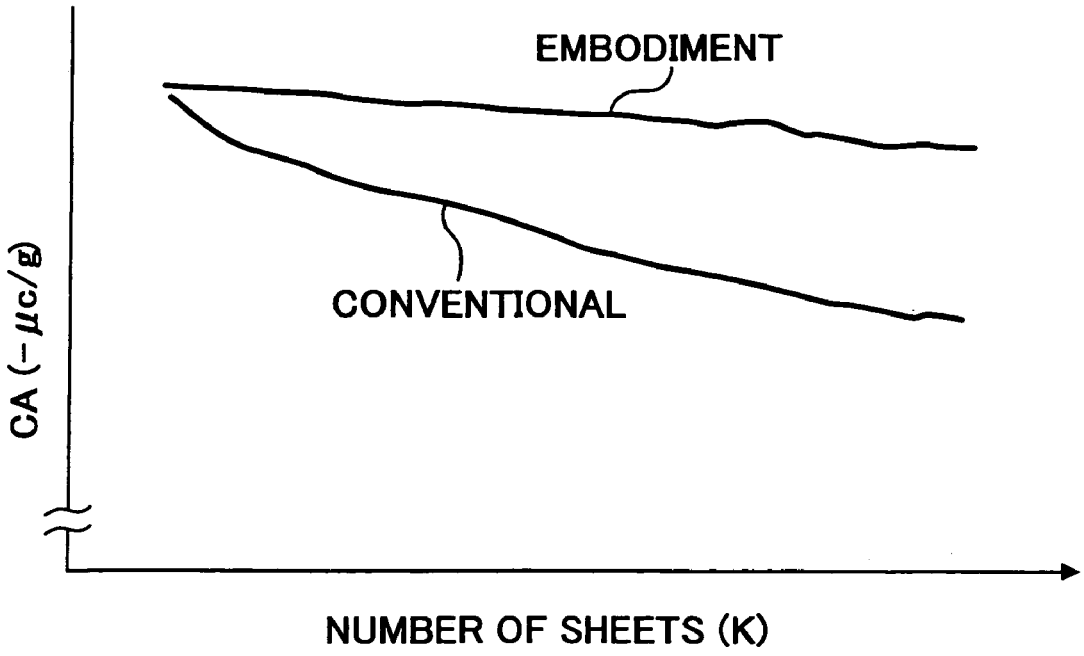
FIG. 13 is a table listing the results of Experiment 2 conducted with the illustrative embodiment.
FIG. 14 is a graph comparing the illustrative embodiment and a comparative example as to how the carrier charging ability CA varies in accordance with the number of sheets output.

FIG. 13 shows the results of Experiment 2, the stability of toner charging estimated by varying the ratio of the maximum thickness r1 to the maximum thickness r to 1/1, 1/2, 1/3 and 1/4. While the variation of charge of toner ascribable to the environment should preferably be small, a condition in which a change in the amount of charge, |ΔQ/M|, in an HH (high temperature and high humidity; 30° C. and 90%) environment and an LL (low temperature and low humidity; 10° C. and 15%) environment was 4 μc/g or less and a condition in which the above change exceeded 4 μc/g were ranked by "○(good)" and "×(no good)", respectively.

As FIG. 13 indicates, the stability of toner charging is "○" against the variation of environment when the ratio r1/r is 1/3 or below. This is presumably because a local or a momentary increase in stress ascribable to, e.g., a change in the fluidity of the developer is reduced, freeing the toner of the developer from excessive stress. The illustrative embodiment therefore limits the ratio r1/r to 1/3 or below.

For a series of estimations stated above, a DC bias was used for development. A DC bias can reduce electric stress to act on the carrier in the developing zone and can therefore stabilize the amount of charge to deposit on the toner. However, a problem with a DC bias is that granularity is sometimes conspicuous in an output image even when the amount of the developer to pass through the doctor gap only slightly varies. This is particularly true when the gap for development is large. In light of this, setting having a margin against the above slight variation is desired. In a strict sense, the amount of the developer to pass through the doctor gap slightly varies due to the rotation of the sleeve. This variation is ascribable partly to mechanical factors including the oscillation of the sleeve and partly to process factors including a change in the density of the stationary layer XB ascribable to a change in the fluidity of the developer. A change in the fluidity of the developer refers to a change in the toner content of the developer and a change in the amount of fine toner grains present in the developer.

When the density of the developer, staying at the position upstream of the doctor gap, exceeds compression density, the ratio of the stationary layer XB to the flowing layer XA increases at the above position. For example, even when the slack apparent density ρr of the developer is as low as 1.8 g/cm$^2$ or so, the bulk density varies to about 2.4 g/cm$^2$after about 10 times of tapping. As a result, the amount of the developer to pass through the doctor gap varies, aggravating the granularity of an output image. By contrast, the illustrative embodiment insures a highly smooth image with a minimum of granularity despite the use of a DC bias for development.

In the illustrative embodiment, the adjustment of the casing clearance is implemented by the burying member 45*u* positioned on the back of the doctor. In practice, however, such adjustment may be implemented by the configuration of the casing.

FIG. 14 compares the illustrative embodiment, which adopts the condition 5 and other conditions described above, and the conventional device as to how the carrier charging ability CA varies in accordance with the number of sheets output. For measurement, only a DC bias was used for development while the amount of toner to deposit on a solid image portion after development was set to be 0.5 mg/cm$^2$. The drum and sleeve had diameters of 90 mm and 25 mm, respectively, while the gap Gp for development was 0.3 mm. The amount of the developer fed to the developing device was 400 g. A chart with a print ratio of 5% representative of a low image area ratio was used as an image for estimation for the purpose of accelerating the degradation of the developer. As FIG. 14 indicates, the illustrative embodiment lowers the carrier charging ability CA less than the conventional printer. The conventional device caused toner to be scattered around, but the illustrative embodiment did not.

Granularity was additionally estimated although not shown in FIG. 14. The estimation showed that the conventional device caused the amount of the developer passing through the doctor gap to start decreasing and made granularity conspicuous when about 10,000 sheets were output, but the illustrative embodiment prevented the above amount from varying and brought about a minimum of granularity.

Further, the illustrative embodiment extends the life of the developer for thereby reducing the frequency of periodic maintenance.

In the illustrative embodiment, the ratio of the stationary layer angle θd to the inter-pole angle θ1 is selected to be 1/3 or less, i.e., in such a manner as to satisfy 0≦θd≦θ1/3, as stated earlier. This reduces stress to act on the developer present in the developer layer X to an allowable range for thereby enhancing stable toner charging as well as the durability of the developer.

The ratio r1/r of 0 or above, but 1/3 or below, allows the local or the momentary increase of torque ascribable to, e.g., a change in the fluidity of the developer to be reduced, so that the toner of the developer is free from excessive stress. It is therefore possible to enhance stable charging against the variation of environment.

The magnetic member 45*t*, forming part of the doctor 45, allows the amount of the developer passing through the doctor gap to remain stable against the variation of the amount of the developer, which occurs at the position upstream of the doctor.

The nonmagnetic casing C covers the upper end portion of the magnetic member 45*t* remove from the sleeve surface, so that the doctor can be efficiently used for further enhancing stable toner charging.

The amount of the developer to be conveyed to the doctor gap can be easily adjusted on the basis of the flux densities of the conveying poles P6 and P7, which intervene between the scoop-up pole P5 and the doctor pole P8 in the direction of movement of the sleeve surface. Also, there can be increased a margin against disturbance that occurs when the developer is moved from the screws 43 and 44 toward the sleeve surface.

With the polymerized, spherical color toner produced by the previously stated method, it is possible to form high-quality images desirable in transparency, sharpness, gloss and reproducibility.

The toner has a weight-mean grain size of as small as 4.0 μm or above, but 8.0 μm or below, and a grain size distribution Dv/Dn of as sharp as 1.25 or less, realizing sharp, high-definition images. Further, the toner is preservable against heat and fixable at low temperature and withstands hot offset and forms highly glossy images when applied to a full-color copier, among others. In addition, even when the toner is repeatedly consumed and replenished over a long period of time, the grain size of the toner varies little, so that desirable, stable development is insured despite a long time of agitation.

The toner, having mean circularity of 0.90 or above, but below 1.00, is highly fluid, desirably dispersed when replenished, and rapidly charged. Also, because the non-electrostatic adhesion of the toner to the photoconductive element is weak, irregularity-free development and highly efficient, desirable image transfer are achievable, insuring high image quality.

The carrier used in the illustrative embodiment has a volume-mean grain size of as small as 25 μm or above, but 55 μm or below. This prevents the coating ratio of the toner on the carrier from increasing to thereby effectively obviating toner scattering, background contamination and other problems. Further, a toner image faithful to a latent image can be reproduced. In addition, such a small grain size of the carrier increases the electric field around the carrier, allowing a small developing potential to suffice for development.

The potential Vd to deposit on the drum 2 at the time of uniform charging, the potential VL after development and the bias VB for development satisfy the relation of $0<|VD|-|VB|<|VD-VL|<400$ (V). This relation reduces electrostatic hazard on the drum in the event of charging and exposure and reduces mechanical stress because of the highly fluid developer, thereby reducing stress to act on the developer, which is about to pass through the doctor gap, and stabilizing the amount of such part of the developer. Consequently, high-quality images can be stably output. Further, the life of the developer is extended, implementing PM-less development.

A DC bias used as a bias for development successfully reduces electric stress to act on the carrier in the developing zone, stabilizing the amount of toner charge over a long period of time.

Second Embodiment

Figure 15:
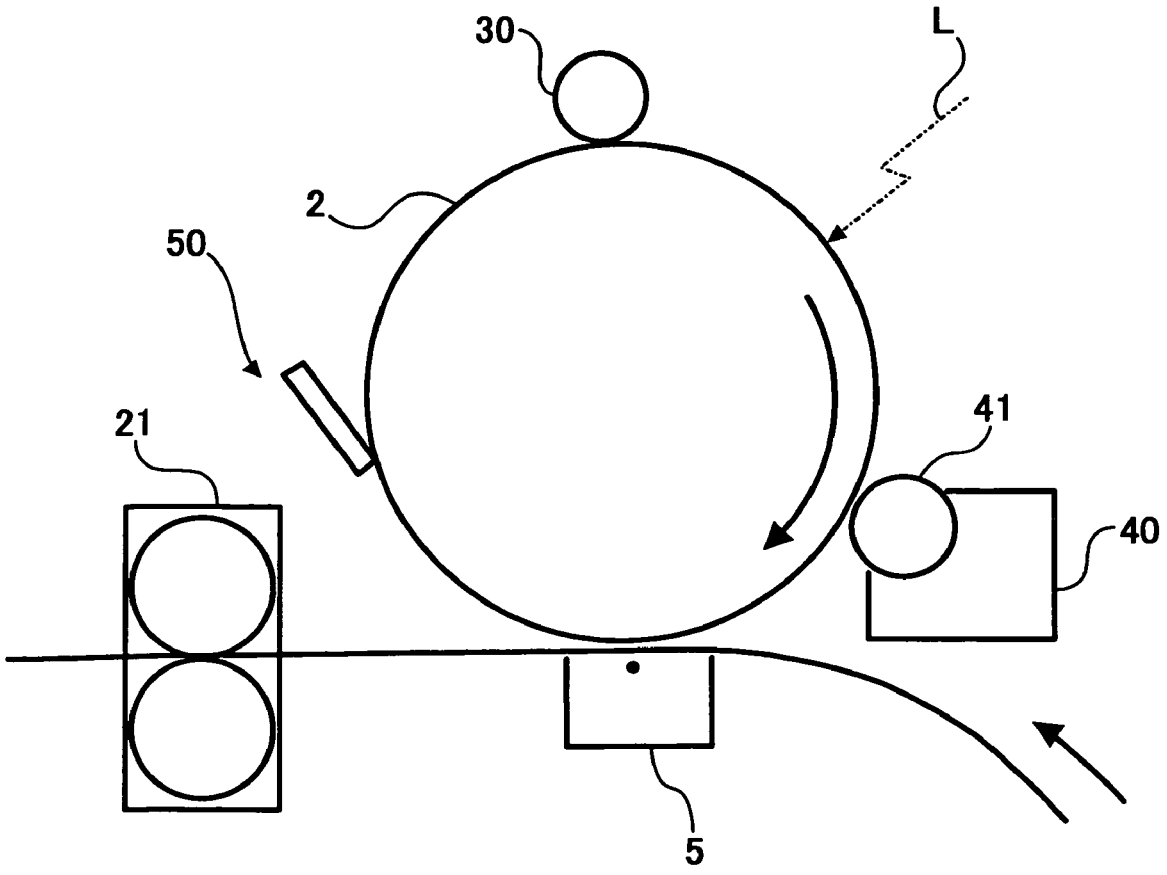
FIG. 15 is a view showing a second embodiment of the image forming apparatus in accordance with the present invention.
Figure 16:
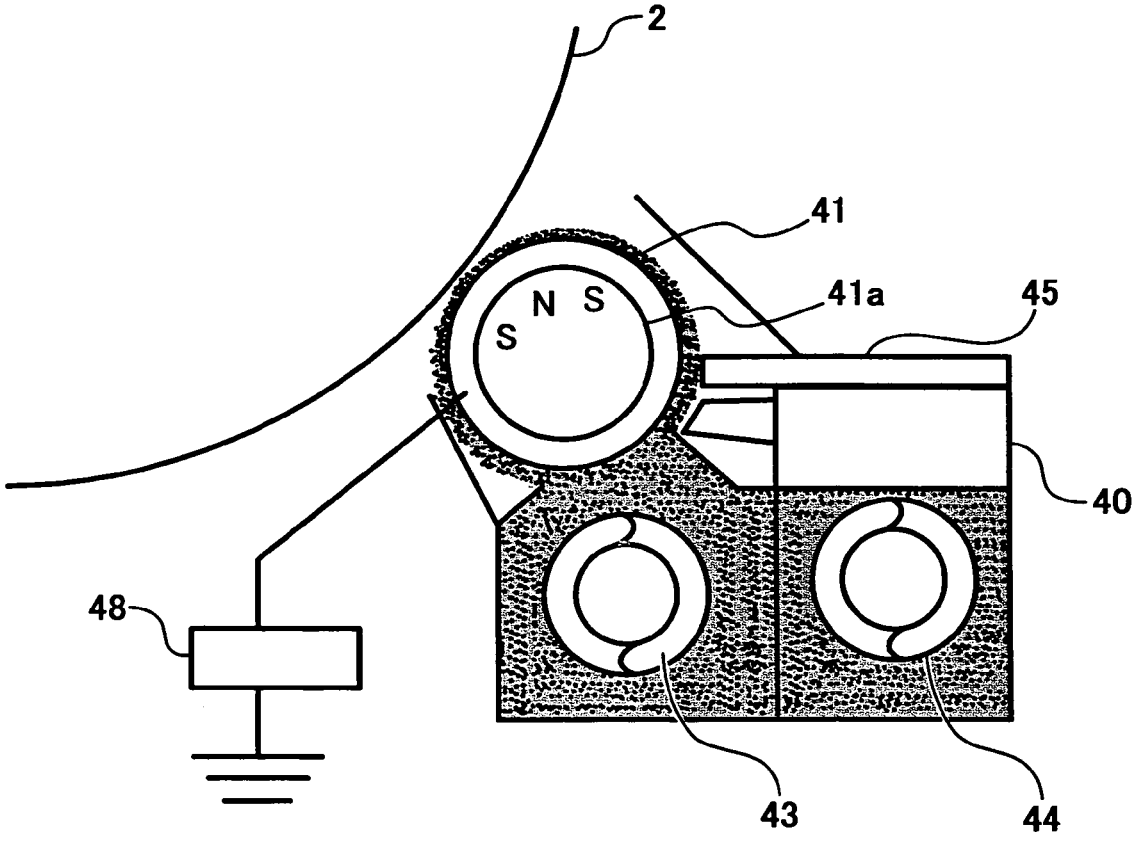
FIG. 16 shows the configuration of a developing device included in the second embodiment.

This embodiment is directed toward the second and third objects stated earlier. Reference will be made to FIGS. 15 and 16 for describing an electrophotographic image forming apparatus and a developing device included in the same and using a two-ingredient type developer.

As shown in FIG. 15, the image forming apparatus includes a charger 30, an exposing unit represented by a laser beam L, a developing device 40, an image transferring device 5 and a cleaning device 50, which are arranged around a photoconductive drum or image carrier 2. A fixing unit 21 fixes a toner image transferred to a sheet or recording medium by the image transferring device 5.

The drum 2, made up of a hollow core and a photoconductor coated on the core, is caused to rotate in a direction indicated by an arrow in FIG. 15 by a drive mechanism not shown. After the charger 30 has uniformly charged the surface of the drum 2 to a preselected potential, the laser beam L scans the charged surface of the drum 2 imagewise to thereby form a latent image. The developing device 40 develops the latent image to thereby produce a corresponding toner image, as will be described hereinafter.

As shown in FIG. 16, the developing device 40 includes a developer chamber storing a developer made up of toner grains and carrier grains. Rotatable screws 43 and 44 are disposed in the toner chamber and rotated to evenly circulate the developer in the developing device 40, uniformly dispersing the toner grains in desired density while charging them by friction. A rotatable sleeve or developer carrier 41 is positioned above the screws 43 and 44 in such a manner as to face the drum 2 at a preselected distance. A magnet roller 41*a*, provided with N and S poles thereon, is held stationary within the sleeve 41. When the sleeve 41 is rotated by a drive source, not shown, the developer is scooped up onto the sleeve 41. A doctor or metering member 45 removes excess part of the developer deposited on the sleeve 41, so that the developer is conveyed to a developing zone between the drum 2 and the sleeve 41 in a preselected amount.

A power supply 48 applies a voltage to the sleeve 41 so as to form between the sleeve 41 and the latent image formed on the drum 2 an electric field corresponding to the latent image. The electric field causes the charged toner, which is present in the developer deposited on the sleeve 41, to deposit on the latent image for thereby forming a corresponding toner image.

The toner image thus developed on the drum 2 is transferred from the drum 2 to a sheet by the image transferring device 5 and then fixed by the fixing unit 21, which uses heat and pressure for fixation. Part of the toner left on the drum 2 after the image transfer is removed by the cleaning device 50 and then returned to the developing device 40 via a toner recycling path.

While the toner content of the developer decreases little by little due to repeated development, a toner replenishing mechanism, not shown, replenishes a necessary amount of fresh toner, as needed. The developer is subject to heavy stress due to a long time of agitation and doctor 45, as stated previously.

The illustrative embodiment will be described more specifically hereinafter. The drum 2 is made up of a tube formed of, e.g., aluminum and an organic or an inorganic conductor coated on the tube and forming a photoconductive layer, which consists of a charge generating layer and a charge transport layer. The drum 2 may, of course, be replaced with a photoconductive belt, if desired.

The sleeve 41 is partly exposed to the outside in such a manner as to face the drum 2. The screws 43 and 44 operate in the same manner as in the first embodiment and sufficiently mix replenished toner with the carrier before the resulting mixture is fed to the sleeve 41.

The sleeve 41 is formed of aluminum, nonmagnetic stainless steel or similar nonmagnetic material and has a surface formed with suitable projections and recesses by, e.g., sandblasting. A drive source, not shown, causes the sleeve 41 to rotate at adequate linear velocity. The magnet roller 41*a*, held stationary within the sleeve 41, allows the developer to be retained on the sleeve 41 and conveyed toward the latent image formed on the drum 2. The magnetic poles of the magnet roller 41*a* each play a particular role. Magnetic poles basically required of the magnet roller 41*a* are a developing pole that causes the developer to rise in the form of brush chains in the developing zone, a scooping pole for scooping up the developer onto the sleeve 41, and conveying poles for conveying the developer. The magnet roller 41*a* may be provided with five poles to ten poles in total.

The doctor 45 is positioned upstream of the point where the sleeve 41 and drum 2 are closest to each other in the direction of rotation of the sleeve 41. The developer, metered by the doctor 45 as stated earlier, is caused to form a magnet brush on the sleeve 41 by the magnet roller 41*a* and contact the latent image formed on the drum 2. The power supply 48 is connected to the sleeve 41 for forming an electric field, as stated previously.

The linear velocity of the sleeve 41 should preferably be 1.1 times to 3.0 times, more preferably 1.5 times to 2.5 times, as high as the linear velocity of the drum 2. Liner velocity would render image density short if lower than the above range or would bring about toner scattering and disturb an image if higher than the same.

While the size of a gap Gp for development between the drum 2 and the sleeve 41 is dependent on the grain size of the carrier and the amount ρ of the developer scooped up onto the sleeve 41, it should preferably be as small as 0.2 mm to 0.5 mm in order to provide a developing ability with a margin.

The toner may be produced by the conventional method, i.e., mixing binder resin, wax, colorant and, if necessary, a charge control agent in, e.g., a mixer, kneading the resulting mixture with a heat roll, an extruder or similar kneader, solidifying the mixture thus kneaded, pulverizing the solidified mixture, and then classifying the resulting powder. However, polymerized spherical toner, having a small grain size and a narrow grain size distribution and easy to produce, is advantageous over the above pulverized toner from the image and cost standpoint.

Silica, alumina, titanium oxide and other inorganic fine grains should preferably be attached to the surfaces of the toner grains in order to enhance fluidity, development and charging. The primary grain size of such inorganic fine grains should preferably be between 5 μm and 2 μm, more preferably between 5 μm and 500 μm. The specific surface area of the toner grains, as measured by a BET method, should preferably be between 30 $m^2/g$ to 500 $m^2/g$. The ratio of the inorganic fine grains should preferably be between 0.01 wt % and 5 wt %, more preferably between 0.5 wt % and 3.0 wt %, of the toner grains. Further, the mixture ratio of the toner grains should preferably be between 1 wt % and 10 wt % for 100 wt % of carrier grains.

The heaviest stress to act on the developer is exerted by the doctor 45, i.e., the frictional force of the doctor 45 acting on the developer when the developer passes the doctor 45. On the other hand, excess part of the developer that does not pass the doctor 45 stays at the position upstream of the doctor 45 and is retained by the electric field in a densely packed state together with the developer to follow. This presumably accelerates the deterioration of the toner and carrier grains.

To extend the life of the developer, it is effective to reduce the amount of the developer to be subject to the stress, i.e., the amount of the developer to deposit on the sleeve 41. To reduce the amount of the developer to deposit on the sleeve 41, a magnetic force, acting at the position upstream of the doctor 45 in the direction of rotation of the sleeve 41, may be weakened. Also, to reduce the frictional force of the doctor 45 causative of stress, the doctor 45 may be partly or entirely formed of a magnetic material. More specifically, when the doctor 45 is formed of a magnetic material, a magnetic flux, issuing from the pole of the sleeve 41 adjacent to the doctor 45, concentrates on the doctor 45 and allows a gap Gd between the sleeve 41 and the doctor 45 to be made larger than when the doctor 45 is not formed of a magnetic material.

To prevent the components of the toner grains from adhering to the carrier grains and lowering the charging ability of the carrier grains, there should preferably be used carrier grains each being coated with a layer in which at least binder resin contains acrylic resin and grains.

The cores of the carrier grains should preferably have a mean grain size of at least 20 μm in order to prevent the carrier grains from depositing on the drum 2, but not greater than 80 μm in order to reduce the granularity of an image. In practice, the cores may be formed of ferrite, magnetite, iron, nickel or similar conventional material for electrophotography, depending on the application of the carrier grains.

The grains contained in the coating resin may be formed of, e.g.,alumina, titanium oxide or zinc oxide either singly or in combination. Further, if the thickness h of the carrier coating layers is made smaller than the grain size d, then the grains are exposed via the coating layers, further enhancing the improvement stated above. In addition, the ratio of the carrier coating layers should preferably be between 0.2 wt % and 5.0 wt % of the weight of the carrier cores.

The grains contained in the carrier coating resin serve to protect the coating layers from extraneous forces that act on the carrier surfaces, and to cause the carrier grains to contact each other and scrape off toner components deposited thereon. The grains stated above are highly resistant to extraneous forces and can protect the coating layers without any crack or wear over a long period of time. In addition, the grain size, layer thickness and amount stated above are desirable as grains for forming projections and recesses on the carrier surfaces and maintaining the carrier surfaces in the initial state.

More specifically, the size of the grains, contained in the carrier coating resin, would prevent the expected effect from being achieved if excessively small relative to the size of the cores or would cause the grains to easily part from the carrier cores if excessively large. Also, the thickness of the coating layers would prevent the grains from protruding from the layers if greater than the grain size. Further, the amount of the above grains would make it difficult to achieve the expected effect if excessively small or would cause the grains to easily part from the coating layers if excessively large. The grains should preferably be present in acrylic resin, so that they can be retained over a long period of time by the strong adhesion of acrylic resin.

Specific examples of the illustrative embodiment, which are not limitative, will be described hereinafter.

[Production of Toner 1]

50 parts by weight of polyester resin (A1), 50 parts by weight of polyester resin (B1), 5 parts by weight of carnauba wax, 2 parts by weight of charge control agent (metal salt of a salicylic derivative) and eight parts by weight of colorant (carbon black) were sufficiently mixed by a blender. The resulting mixture was kneaded by a double-axis extruder, cooled, pulverized and then classified to produce toner 1 having a volume-mean grain size of about 6.8 μm, a ratio Dv/Dn of 1.32 and circularity of 0.89. In the above mixture, the material A1 contained no THF-unsoluble component and had a weight-mean molecular weight of 7,000, a glass transition point Tg of 68° C. and an SP value of 11.3. The material B1 contained 30 THF-unsoluble component and had a weight-mean molecular weight of 10,000, a glass transition temperature Tg of 61° C. and an SP value of 10.7.

[Production of Toner 2]

274 parts by weight of a substance with 2-mole bisphenol A ethylene oxide added thereto, 276 parts by weight of isophthalic acid and 2 parts by weight of dibutyltin oxide were introduced into a reaction bath provided with a cooling tube, an agitator and a nitrogen inlet tube. The mixture was then caused to react for 8 hours at 230° C., caused to further react for 5 hours at pressure lowered to 10 mmHg to 15 mmHg and then cooled off to 160° C. Subsequently, 32 parts by weight of phthalic anhydride was added to the above mixture and caused to react with the mixture for 2 hours. The resulting mixture was then cooled off to 80° C. and then caused to react with 188 parts by weight of isophorone diisocyanate for two hours in ethyl acetate, producing an isocyanate-containing prepolymer (1). 267 parts of this prepolymer (1) and 14 parts of isophoron diamine were caused to react for 2 hours at 50° C., producing urea-modified polyester (1) having a weight-mean molecular weight of 64,000.

Likewise, 724 parts by weight of a substance with 2-mole bisphenol A ethylene oxide added thereto and 276 parts by weight of phthalic acid were polycondensed for 8 hours at 230° C. under normal pressure and then caused to react for 5 hours at pressure lowered to 10 mmHg to 15 mmHg, producing non-modified polyester (a) having a peak molecular weight of 5,000. 200 parts by weight of urea-modified polyester (1) and 800 parts by weight of non-modified polyester (a) were dissolved in 2,000 parts by weight of a ethyl acetate/MEK (1/1) mixture solvent and mixed together to prepare a ethyl acetate/MEK solution of a toner binder (1). This solution was partly dried in a partially depressurized condition to thereby separate the toner binder (1). The toner binder (1) had a glass transition temperature Tg of 62° C.

240 parts by weight of the ethyl acetate/MEK solution of the binder (1), 20 parts by weight of pentaerythritol-tetra-behenate having a melting point of 81° C. and melt viscosity of 25 cps and 4 parts by weight of carbon black were introduced into a beaker and then agitated in a TK type homomixer at 60° C. and 12,000 rpm to be evenly dissolved and dispersed thereby. Subsequently, 706 parts by weight of ion exchange water, 294 parts by weight of hydroxyapatite 10% suspension SUPERTITE 10 (trade name) available from Nippon Chemical Industrial Co., Ltd. and 0.2 part by weight of dodecylbenzen sodium sulphonate were introduced into a beaker and then evenly dissolved. Subsequently, the resulting mixture was heated to 60° C., then the above toner material solution was introduced into the heated mixture while being agitated in a TK type homomixer for 10 minutes at 12,000 rpm. Thereafter, the mixture solution was transferred to a flask, heated to 98° C. to remove the solvent, filtered, rinsed, dried and then classified by air to thereby produce toner grains. The toner grains had a volume-mean grain size Dv of 5.5 μm and a number-mean grain size Dn of 4.8 μm, so that the ratio Dv/Dn was 1.15. Further, the rotation speed and agitation time used when the toner material solution was introduced and agitated were varied to produce other toner grains 3 through 6 each having a particular grain size, a particular ratio Dv/Dn and particular circularity.

FIG. 17 shows toners 1 through 6 each having a particular grain size, a particular ratio Dv/Dn and particular circularity. The toners 1 through 6 each were produced by mixing 100 parts by weight of mother toner and 0.4 part of hydrophobic silica, which was an additive, in a Henschel mixer. Specific examples of the illustrative embodiment will be described hereinafter.

[Production of Carrier 1]

56.0 parts by weight of acrylic resin solution, containing 50 wt % of solids, 15.6 parts by weight of guanamine solution, containing 70 wt % of solids, 160.0 parts by weight of alumina grains (1.5 wt % for the weight of a core material) having a grain size of 0.1 μm, 900 parts by weight of toluene and 900 parts by weight of butylcellosolve were dispersed for 10 minutes in a homomixer to thereby prepare an acrylic-resin coating layer forming solution. This solution was coated on core grains, which were implemented by sintered ferrite powder having a grain size of 35 μm, by a Spila Coater (trade name) available from OKADA SEIKO and then dried. The resulting carrier grains were left in an electric furnace for 1 hour at 150° C. to be calcined thereby. Subsequently, the carrier grains were cooled and then sieved to produce a carrier 1. Further, carriers 2 and 3 were produced by replacing the above ferrite powder with ferrite powders having grain sizes of 15 μm and 65 μm, respectively.

[Production of Carrier 2]

132.2 parts by weight of silicon resin solution containing 23 wt % of solids, 0.66 parts by weight of aminosilane containing 100 wt % of solids, 121.0 parts by weight of alumina grains having a grain size of 1.3 μm and resistance of 1,014 Ω·cm, 300 parts by toluene and 300 parts by weight of butylcellosolve were dispersed for 10 minutes in a nomomixer to thereby prepare a silicone-resin coating layer forming solution. A carrier 4 was produced by use of sintered ferrite powder having a grain size of 35 μm as a core material by the same method as in Production of Carrier 1.

The toners and carriers stated above were compared as to toner scattering, background fog, carrier deposition and carrier charging ability C. For comparison, the amount of the entire developer in the developing device of a test machine and the amount of the developer to deposit on a sleeve were varied. Estimation was made after an image with an area ratio of 5% was repeatedly formed on 200,000 sheets. Carrier deposition was determined by examining the images by eye and classified into ranks "◎ (excellent)", "○(good)", "Δ (acceptable)" and "×(no good)". Likewise, toner scattering was determined by examining smearing inside the test machine by eye and classified into the above four ranks. To estimate the carrier charging ability CA, only the carrier grains were taken out before and after the repeated image formation in order to determine a decrease in charge occurred when the toner grains were newly mixed with toner grains. The carrier charging ability CA was determined to be "○ (good)" when the above decrease was between 0 μc/g and 5 μc/g, "Δ (acceptable)" when it was between 5 μc/g and 10 μc/g or "×(no good)" when it was greater than 10 μc/g. FIG. 18 lists the results of estimation.

As shown in FIG. 18, when conditions 1 through 9 were tested by replacing the toner and carrier while fixing the amount of the entire developer and the amount of the developer on the sleeve, the conditions other than the condition 9 did not cause the charging ability to decrease. Although the granularity of an image was improved as the grain sizes of toner and carrier decreased, such grains sizes are excessively small. The condition 5 is slightly inferior in toner scattering and background contamination while the condition 7 is slightly inferior in carrier deposition. The condition 6 with a large toner grain size and the condition 8 with a large carrier gain size are desirable in toner scattering and carrier deposition although inferior in granularity. Further, the conditions 1 and 4 each having a broad toner grain size distribution and the conditions 1 and 3 each having low circularity are also inferior in granularity.

As for conditions 10 through 15 in which the amount of the developer on the sleeve and the amount of the entire developer were varied, the conditions 12 and 14 with a small amount of developer on the sleeve did not cause the charging ability to decrease. However, the other conditions with a large amount of developer on the sleeve all caused the charging ability to noticeably decrease. Particularly, the condition 14 using a nonmagnetic metering member lowered the charging ability far more than the conditions 2 through 7 and 12 using a magnetic metering member. This proves that a magnetic material is superior to a nonmagnetic material as to a margin.

The illustrative embodiment is also practical with the process cartridge of the first embodiment shown in FIG. 3.

As stated above, the illustrative embodiment provides toner that does not adhere to the surface of a carrier and prevents its coating resin from being shaved off. Further, by using such toner, it is possible to maintain charging stable over a long period of time and therefore to reduce background fog and toner scattering against aging.

Third Embodiment

This embodiment is directed toward the fourth and fifth objects stated earlier. A developing method unique to the illustrative embodiment will be described first. As for the configuration and operation of a developing device, this embodiment is essentially identical with the first embodiment described with reference to FIGS. 2 through 4 and will therefore be described with reference also made to FIGS. 2 through 4, as needed.

Figure 19:
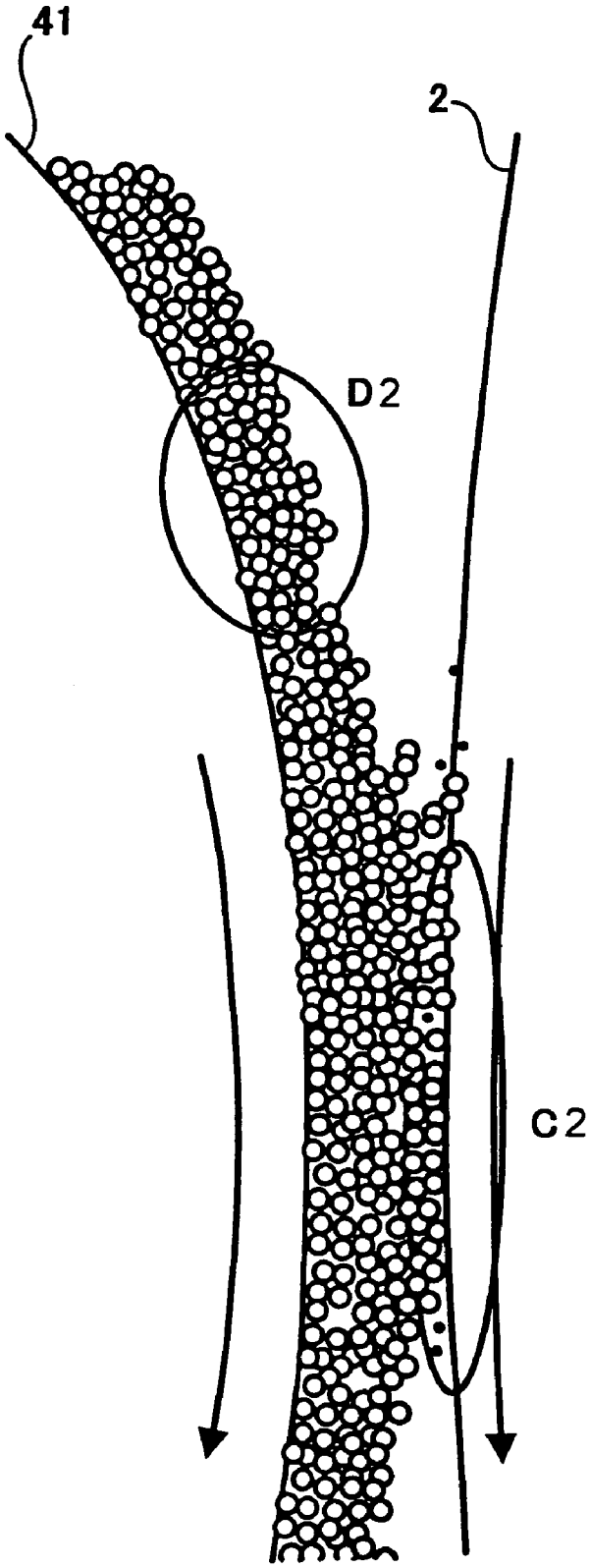
FIG. 19 shows the condition of a two-ingredient type developer in a developing zone relating to a developing method representative of a third embodiment of the present invention.
Figure 20:
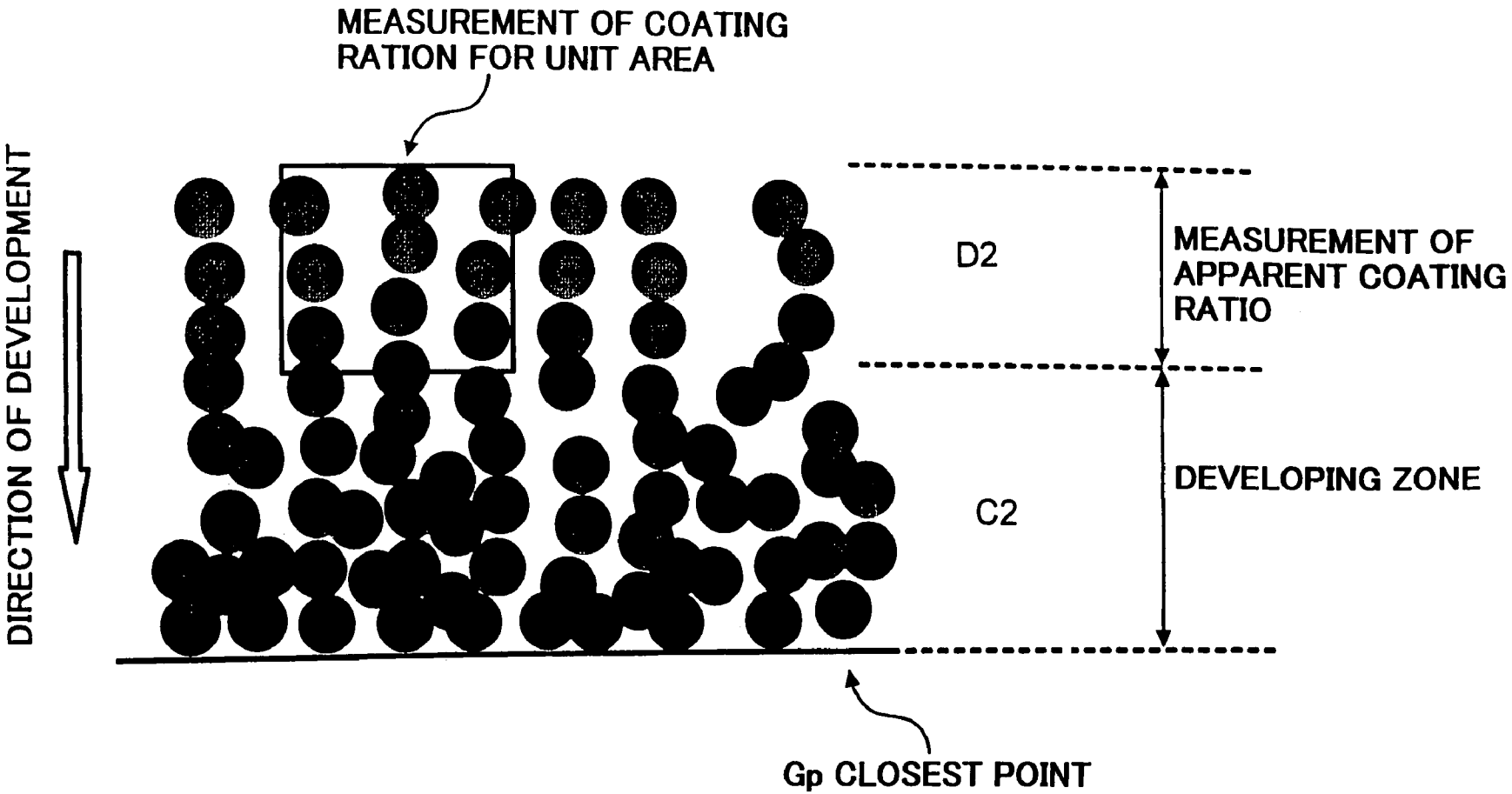
FIG. 20 shows the developing zone of FIG. 19 as seen from the drum side.
Figure 21:
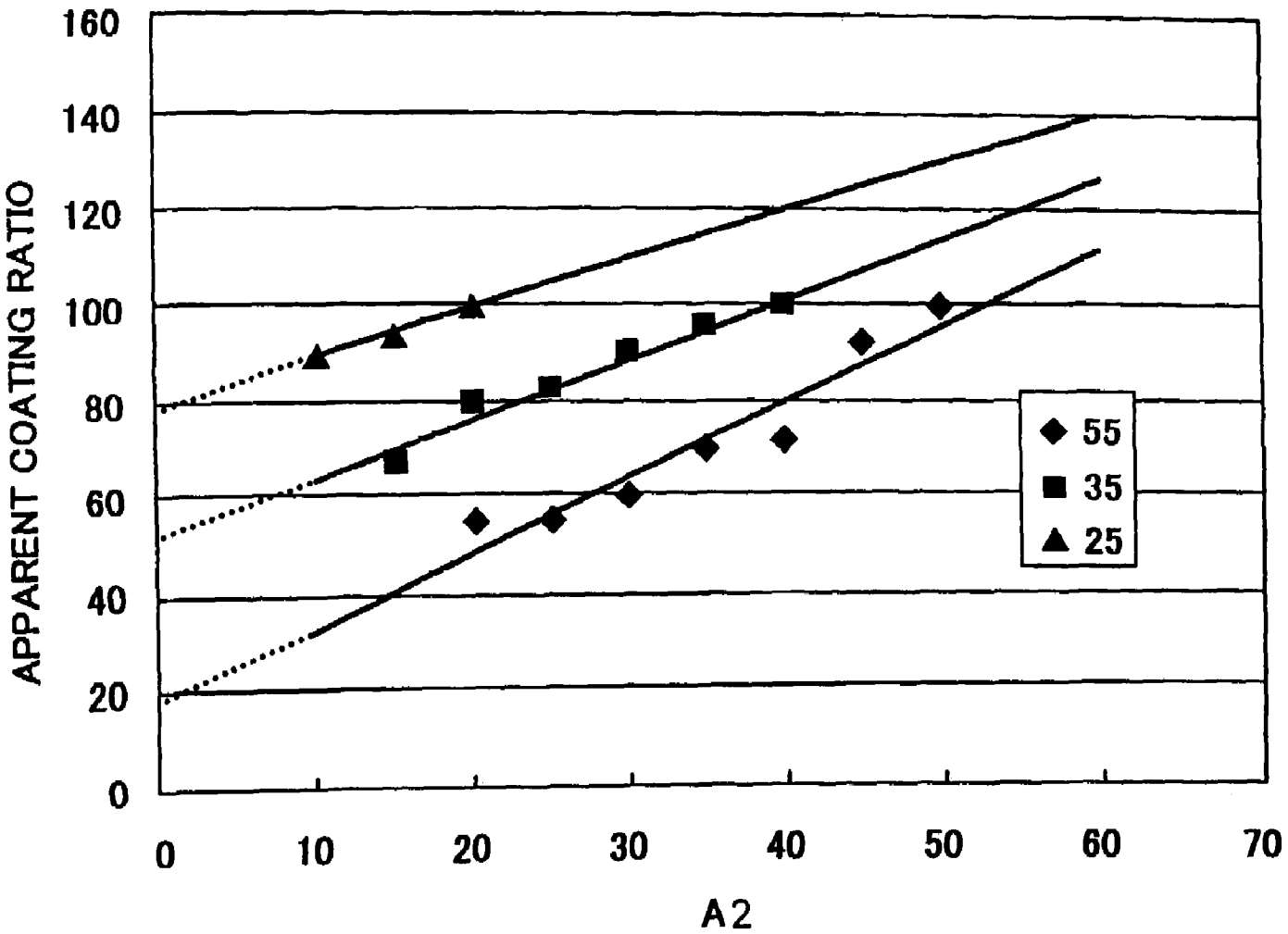
FIG. 21 is a graph showing a relation between an apparent coating ratio and an amount of developer conveyed.

FIG. 19 shows the condition of a two-component type developer being conveyed via a developing zone in accordance with the illustrative embodiment. FIG. 20 shows the condition of FIG. 19 in the developing zone, as seen from the drum 2 side. The sleeve 41 accommodates the magnet roller not shown, as stated earlier. Labeled C2 and D2 are respectively a developing zone and a zone where an apparent coating ratio is measured. The developing zone C2 refers to a zone where a magnet brush, i.e., brush chains formed by carrier grains contact the drum 1 and cause, while varying in condition themselves, toner grains to move toward the drum 2. Carrier grains, moving toward a main pole for development, exist between near by magnets, so that magnetic lines of force in the normal direction are small, but magnetic lines of force in the tangential direction are large because the nearby magnets are opposite in polarity to each other. Such carrier grains therefore form a thinner developer layer than carrier grains present on the magnets.

When the thinner developer layer mentioned above arrives at a magnet, not shown, that exerts a main magnetic force for development, some carrier grains gather and rise in the form of a brush chain. While the number of carrier grains so forming a brush chain is generally determined by the amount of the developer passed the doctor or metering member, it is determined also by the size and slope of magnetic lines of force, which are dependent on the magnetic property carrier grains, the size of the magnetic force, shape and position of the magnet.

When the developer is being passed through the developing zone C2 in the form of a magnet brush, the behavior of the developer varies in accordance with the packing state of the developer in the zone C2, gap for development and linear velocity ratio of the sleeve 41 to the drum 2. As for the behavior of the developer in the developing zone C2, the developer should ideally move at substantially the same speed around the sleeve 41 and around the drum 2, as seen in the direction of a section. In this condition, it is possible to implement high-quality images free from carrier deposition and the omission of halftone in the peripheral portion of a solid image.

On the other hand, if the density of the developer in the developing zone C2 is higher than bulk density, then a difference in speed between the developer layer right above the sleeve 41 and the developer layer adjoining the drum 2 increases. More specifically, the speed of the developer layer adjoining the drum 2 is lower than the speed of the developer right above the sleeve 41. To solve this problem it is necessary that a sufficient, magnetic restraining force be exerted on the developer adjoining the drum 2 in the developing zone C2. This can be effectively done if the developer layer is made thinner. A thinner developer layer, combined with a narrower gap for development, is desirable from the faithful reproduction standpoint as well.

In light of the above, the illustrative embodiment maintains the developer layer in an optimum condition before it enters the developing zone C2 to thereby prevent an excessive frictional force from acting on toner grains in the zone C2. This allows effective development to be effected in a zone where the magnet brush is dense and the electric field for development is uniform.

The prerequisite with a DC development system is that the uniformity of the magnet brush in the developing zone C2 be enhanced in order to form a uniform image with low granularity. However, this prerequisite cannot be met unless the magnet brush is uniform before entering the developing zone C2. In FIG. 20, there are shown the measuring zone D2, which precedes the developing zone C2, and developing zone C2, as seen from the drum 2 side. As shown, if the developer layer is not uniform in the measuring zone D2, then it is not uniform in the developing zone C2 either. This is presumably because the developer, particularly the carrier grains supporting the toner grains, cannot easily move in the axial direction of the sleeve.

We observed the condition of the magnet brush present in the measuring zone D2 preceding the developing zone C2. For estimation, use was made of a test machine. The sleeve 41 and drum 2 had diameters of 30 mm and 90 mm, respectively. The drum 2 comprised a false photoconductive drum implemented by a transparent drum formed of acrylic resin. After rotating the sleeve 41 and transparent drum 2 at preselected linear velocity, we confirmed the condition of the developer layer before the developing zone through the transparent drum 2 with a stereoscopic microscope; a projected area was measured and therefore data were bidimensional. Although estimation itself can be made without using a transparent drum, an actual drum must be removed in the event of observation if used. The resulting vibration might obstruct accurate observation of the condition of the magnet brush. The surface of the false drum was provided with the same coefficient of friction μ as the surface of the actual drum 2. The stereoscopic microscope used for estimation comprised SZ-STB1 (trade name) available from OLYMPUS OPTICAL CO., LTD. An image obtained was digitized by image processing software Image Hyper II so as to calculate an apparent coating ratio M (%) expressed as:

$$M=\alpha A2+\beta \quad (1)$$

where α denotes a surface coating coefficient, A2 denotes an amount of developer for a unit area (g/cm$^2$), and β denotes a virtual surface coating coefficient M0 corresponding to a case wherein the amount of the developer scooped up is 0 mg/cm$^2$.

The surface coating coefficients α and β both are numerical values determined by experiments. When the surface coating coefficient α increases, the apparent coating ratio M noticeably varies in accordance with the variation of the amount of scoop-up, i.e., the amount of the developer for a unit area, mg/cm$^2$, on the sleeve 41 that passes the doctor 45, FIG. 4.

In a strict sense, the amount of the developer to pass through the doctor gap between the doctor 45 and the sleeve 41 slightly varies due to the rotation of the sleeve 41. While such slight variation is dependent mainly on the oscillation of the sleeve 41 and the fluidity of the developer, even the slightest variation of the developer is apt to aggravate the granularity of an image in the case of development using a DC bias. It is therefore desirable to provide a margin against such slight variation.

FIGS. 21 through 24 list the results of estimation. The estimation shown in FIG. 22 was conducted with carrier grains having a volume-mean grain size of 55 μm while the estimations shown in FIGS. 23 and 24 were conducted with carrier grains having volume-mean grain sizes of 35 μm and 25 μm, respectively. For experiments, polymerized toner grains with a volume-mean grain size of 5.2 μm were used while the electric field for development was so adjusted as to cause the toner grains to deposit on a solid image portion in an amount of 0.5 mg/cm$^2$.

As FIGS. 22 through 24 indicate, when the apparent coating ratio was 80% or below, images with low granularity were not achievable without regard to the gap for development. On the other hand, when the apparent coating ratio was 125% or above, carrier deposition and the omission of halftone in the peripheral portion of a solid image were conspicuous at higher apparent coating ratios although a condition for reducing granularity existed.

In FIGS. 22 through 24, conditions with hatching satisfy all image-quality items used for estimation. More specifically, by varying the amount of scoop-up, apparent density and gap for development for each of the three different kinds of carrier grains, the degree of achievement with respect to a target value is estimated item by item.

The surface coating coefficient α was 1.57 in FIG. 22 or 1.25 and 1.0 in FIGS. 23 and 24, respectively. It will therefore be seen that carrier grains with a small grain size have an apparent coating ratio that varies little relative to the variation of the amount of scoop-up and are therefore particularly feasible for DC bias type of development. We experimentally determined that the surface coating coefficient α could be reduced if the saturation magnetization of carrier grains or the flux density of the sleeve 41 was reduced.

The virtual surface coating coefficient β is correlated to the gap for development; the gap must be increased with an increase in the coefficient β. The virtual surface coating coefficient β, like the surface coating coefficient α, is greatly dependent on the saturation magnetization, grain size and other powder characteristics of the carrier grains and the magnetic characteristics of the sleeve.

Further, the virtual surface coating coefficient β, which is theoretically zero, is expected to pass the origin in the equation (1) also. The equation (1) holds in a range in which the amount of scoop-up A2 has practical values. In practice, when the amount A2 is 5 mg/cm$^2$ or below, which is a non-practical range, the apparent coating ratio M rapidly converges toward the origin. The coefficient β is the calculated value of the apparent coating ratio M when the amount of scoop-up is 0 mg/cm$^2$, which is derived from the equation (1) in the practical range.

As for a two-component developer, it is desirable to determine the amount of the developer to pass through the developing zone by taking account of the apparent density of the developer. It was found that the developer tended to increase a nip width for development when excessively packed. Apparent density ρr, g/cm$^2{}_1$ is determined by filling up a container with powder dropped by gravity and then leveling the powder, as prescribed by JIS (Japanese Industrial Standards) Z2504, and is sometimes referred to as slack apparent density. In this connection, when vibration is added as post processing, apparent density ρt is higher than the above apparent density ρr, so that the resulting data has desirable reproducibility. the apparent ρt is sometimes referred to as compression density to be distinguished from slack apparent density.

Part of the developer protruding from the expected developing zone, particularly toward the downstream side, brings about carrier deposition, toner scattering and other problems. Even when the apparent density ρr of the developer is about 1.8 g/cm$^2$, bulk density varies to about 1.4 g/cm$^2$ after about ten times of tapping. This condition, however, does not occur in the developing zone, so that the developer tends to increase the nip width, as stated earlier. Even if the density so increases for a moment, a space that allows the toner grains to fly toward the drum 2 is not available in the developing zone with such high developer density, lowering developing efficiency.

Generally, for a given true specific gravity of carrier grains, apparent density decreases with a decrease in the grain size of the carrier grains, so that saturation magnetization, emu/cm$^3$, decreases for given saturation magnetization, emu/g. In this condition, carrier deposition is apt to occur more than expected with a decrease in saturation magnetization for a single carrier grain. To solve this problem, there should preferably be satisfied a relation:

$$Gp \times \rho r < 0.07 \quad (2)$$

This relation allows carrier grains with a small grain size to be used in a desirable condition and therefore improves granularity and carrier deposition at the same time.

For a series of estimations stated above, development was effected with a DC bias. Even when a DC bias is used, we propose the above relation (2) for insuring a high-quality image that appears extremely uniform with a minimum of granularity. Other estimations conducted by us showed that even when the gap Gp for development was as small as 0.3 or below, there existed a condition that provided an image with quality comparable with quality achievable with an oscillation bias. In such a case, the apparent coating ratio M should be confined in the previously stated condition. A DC bias can reduce electric stress to act on carrier grains in the developing zone, so that the amount of charge to deposit on toner grains can be stabilized. Further, by providing the developer layer with the previously stated coating ratio M before the developer layer enters the developing zone, it is possible to reduce mechanical stress to act on toner grains and carrier grains due to an increase in pressure in the developing zone, thereby extending the life of the developer.

While the advantages of the illustrative embodiment are achievable with both of pulverized toner and polymerized toner, the advantages are more enhanced when polymerized spherical toner is used. Experiments were conducted with polymerized spherical toner. To produce the toner of the illustrative embodiment, an oleaginous dispersion is prepared at least by dissolving a polyester-based prepolymer A, which belongs to a family of polyester resins containing isocyanate radicals, in an organic solvent, dispersing a pigment-based colorant in the solvent, and dissolving or dispersing a parting agent in the solvent. The oleaginous dispersion thus prepared is dispersed in a water-based solvent in the presence of inorganic fine grains and/or fine polymer grains. Subsequently, the prepolymer A mentioned above is caused to react with monoamine B, which contains polyamine and/or a radical containing active hydrogen, in the above dispersion, forming urea-modulated polyester-based resin C containing a urea radial. Finally, the liquid medium is removed from the dispersion containing the urea-modulated polyester-based resin C.

The urea-modified polyester-based resin C has a glass transition temperature Tg of 40° C. to 65° C., preferably 45° C. to 60° C., a number-mean molecular weight Mn of 2,500 to 50,000, preferably 2,500 to 30,000, and a weight-mean molecular weight Mw of 10,000 to 500,000, preferably 30,000 to 100,000.

The above toner contains binder resin implemented by the urea-modulated polyester resin C increased in molecular weight by the reaction of the prepolymer A and amine B. The colorant is densely dispersed in such a binder resin.

In the illustrative embodiment, the toner has a weight-mean grain size Dv of 4 μm to 8 μm. The ratio of the grain size Dv to the number-mean grain size Dn of the toner, i.e., Dv/Dn is selected to lie in the range of $$1.00 \leqq Dv/Dn \leqq 1.25 \quad (3)$$

With such a ratio Dv/Dn, it is possible to attain toner implementing high resolution and high image quality. To achieve higher image quality, it is preferable to provide the colorant with a weight-mean grain size Dv of 4 μm to 8 μm, more preferably 4 μm to 6 μm, to confine the ratio Dv/Dn in the range of $1.00 \leqq Dv/Dn \leqq 1.25$, more preferably $1.00 \leqq Dv/Dn \leqq 1.15$. Such toner is preservable against heat and fixable at low temperature and withstands hot offset and forms highly glossy images when applied to a full-color copier, among others. In addition, even when the toner is repeatedly consumed and replenished over a long period of time, the grain size of the toner varies little, so that desirable, stable development is insured despite a long time of agitation.

In the illustrative embodiment, the toner has mean circularity of 0.90 or above, but less than 1.00. Circularity is measured by use of the flow type particle image analyzer FPIA-2000 mentioned earlier and is produced by dividing the circumferential length of a circle identical in area with the projected area of a toner grain by the circumferential length of the projected image. It is important that toner be provided with a particular shape and a particular shape distribution. Toner with mean circularity of less than 0.90 has an amorphous shape and cannot implement satisfactory image transfer or high-quality images free from toner scattering. More specifically, amorphous toner grains each contact the drum or similar smooth medium at many points while causing charges to concentrate on the tips of projections, so that a Van der Waals force and a mirror image force are higher than in the case of relatively spherical toner grains. Consequently, as for toner including both of amorphous grains and spherical grains, the spherical grains selectively move at the time of electrostatic image transfer, causing characters or lines to be lost. Further, the toner left after image transfer must be removed before the next development, resulting in the need for a cleaner as well as in low toner yield.

Pulverized toner, as distinguished from the polymerized toner used in the illustrative embodiment, usually has circularity of 0.910 to 0.920, as measured by the analyzer mentioned earlier. To produce spherical toner with high mean circularity, the method stated previously may, of course, be replaced with emulsification polymerization, suspension polymerization, dispersion polymerization or similar polymerization.

Additives added to the surfaces of toner grains comprise 0.7 part by weight of silica and 0.3 part by weight of titanium oxide. To further increase developing efficiency by reducing physical adhesion of carrier grains and toner grains, 1 part by weight or more of silica may be added to the surfaces of toner grains for thereby enhancing the fluidity of toner grains. This, however, reduces a margin as to the variation of environment ascribable to the variation of the amount of charge and reduces the amount of carrier grains to be scooped up, i.e., the amount of carrier grains to pass through the doctor gap for a unit area during repeated operation.

The illustrative embodiment effects negative-to-positive development by uniformly charging the drum or photoconductive element to a potential VD of −350 V, establishing a potential VL of −50 V after development and applying a bias VB of −250 V for development, i.e., with a developing potential of VL−VB=200 V. At this instant, there holds a relation:

$$0V < |VD| - |VB| < |VD - VL| < 400V \quad (4)$$

In the relation (4), $|VD-VL|<400$ V is selected on the basis of Paschen's law in order to obviate discharge in the exposed and non-exposed portions.

The illustrative embodiment is also practicable with the image forming apparatus and developing device described with reference to FIGS. 2 and 4.

Running tests were conducted with the above image forming apparatus and developing device in order to compare the conditions of the illustrative embodiment and conventional developing conditions as to the variation of the carrier charging ability CA. A DC bias was used for development while the amount of toner to deposit on a solid image portion after development was set to be 0.5 mg/cm$^2$. The gap Gp was selected to be 0.25 in the illustrative embodiment or 0.5 for comparison while the apparent coating ratio M was selected to be 11.5% in the illustrative embodiment or 200% for comparison. The amount of the developer fed to the developing device was 400 g. A chart with a print ratio of 5% representative of a low image area ratio was used as an image for estimation for the purpose of accelerating the degradation of the developer. The results of estimation were similar to the results shown in FIG. 14.

As FIG. 14 indicates, the illustrative embodiment lowers the carrier charging ability CA less than the conventional printer. This difference is presumably accounted for by the following. In the developing zone, stress to act on the developer, i.e., toner and carrier grains includes not only mechanical stress ascribable to an increase in pressure and electric stress ascribable to an AC bias stated above, but also stress relating to the ratio of toner grains used when the developer passes through the developing zone. More specifically, the deterioration of the developer decreases with an increase in the amount of toner grains consumed after the developer has entered the developing zone, but before the former leaves the latter. As for the specific conditions for comparison stated above, when the apparent coating ratio is 115%, the amount of the developer to pass through the developing zone is about one-half, compared to the case wherein the coating ratio is 200%. However, because the amount of toner grains to deposit on a solid image portion is the same, higher developing efficiency is achievable when the coating ratio is small.

Ideally, toner grains contained in the developer should be entirely consumed in the developing zone. The larger the amount of toner not used in the developing zone, the higher the degree of deterioration of the developer. This is presumably why the deterioration of the developer is noticeable when an image with a small image area ratio is repeatedly output than when an image with a large image area ratio is repeatedly output.

The process cartridge of the first embodiment shown in FIG. 3 is directly applicable to the illustrative embodiment as well.

As stated above, in the illustrative embodiment, the coating condition of the developer, deposited on the sleeve, is maintained optimum before the developer enters the developing zone. It is therefore possible to optimize the density of the developer or magnet brush in the developing zone for thereby enhancing the reproducibility of the dot image of a halftone portion. The resulting image is desirable in the aspect of granularity and tonality. Further, the amount of the developer, passing through the developing zone, is adequately controlled to enhance the durability of the developer and stable toner charging. In addition, there can be used carrier grains with low resistance because a DC bias is usable for development and reduces limitations on the resistance of the carrier grains as well as on the uniformity of the carrier coating layers and the material of carrier cores.

Various modifications will become possible for those skilled in the art after receiving the teachings of the present disclosure without departing from the scope thereof.

What is claimed is:

1. An image forming apparatus comprising:

an image carrier configured to allow a latent image to be formed thereon;

a hollow, cylindrical developer carrier provided with a plurality of stationary magnetic poles thereinside; and a metering member configured to limit an amount of a developer, which is made up of a toner and a magnetic carrier and is deposited on said developer carrier, to pass;

wherein one of said plurality of magnetic poles comprises a doctor pole facing said metering member; and wherein a surface of said developer carrier on which the developer is deposited by a magnetic force of one of said plurality of magnetic poles is moved in a circumferential direction to conveyed said developer to a developing zone where said developer faces a surface of said image carrier via a metering position where said developer faces said metering member, causing said developer forming a magnet brush to contact said surface of said image carrier and develop a latent image formed on said surface of said image carrier in an electric field;

said image forming apparatus further comprising stationary layer angle setting means for setting, assuming that a developer layer, staying at a position upstream of said metering member in a direction in which said developer carrier conveys the developer, consists of a stationary layer in which said developer is not replaced and a flowing layer in which said developer is replaced, that an angle between, as seen from an axis of said developer carrier, an upstream edge portion, in said direction, of an end portion of said metering member, which faces said developer carrier, and a position where an end of said stationary layer upstream of, but remote from said edge portion, in said direction is located is a stationary layer angle θd, and that an angle between, as seen from said axis of said developer carrier, said edge portion and a position where a doctor-upstream pole just upstream of said doctor pole in said direction is located is an inter-pole angle θ1, said stationary layer angle θd to be smaller relative to said inter-pole angle θ1.

2. The apparatus as claimed in claim 1, wherein said preselected range is:

$$0 \leqq \theta d \leqq \theta 1/3.$$

3. The apparatus as claimed in claim 2, wherein assuming that the developer layer has a maximum thickness of r in a radial direction of said developer carrier and that said stationary layer has a maximum thickness of r1 in said radial direction, r and r1 are related as:

$$0 \leqq r1/r \leqq 1/3.$$

4. The apparatus as claimed in claim 1, wherein at least part of said metering member comprises a magnetic member.

5. The apparatus as claimed in claim 4, wherein part of said magnetic member other than part, which adjoins the surface of said developer carrier in the radial direction of said developer carrier, is covered with a nonmagnetic member.

6. The apparatus as claimed in claim 1, wherein one of said poles comprises a scoop-up pole for magnetically scooping up the developer onto the surface of said developer carrier, and wherein at least one conveying pole intervenes between said scoop-up pole and said doctor pole in a direction in which the surface of said developer carrier moves, conveying the developer scooped up toward the metering position.

7. The apparatus as claimed in claim 1, wherein the toner is produced by dissolving or dispersing a toner composition, which contains at least a modified polyester resin with an urea-bond ability and a colorant, in an organic solvent to thereby prepare a dissolution or a dispersion, dispersing said dissolution or said dispersion in a water-based medium to thereby effect polyaddition reaction, and then removing said solvent and rinsing.

8. The apparatus as claimed in claim 1, wherein the toner has a weight-mean grain size Dv of 4.0 μm or above, but 8.0 μm or below, and has a ratio Dv/Dn of said weight-mean grain size Dv to a number-mean grain size Dn of 1.0 or above, but 1.25 or below.

9. The apparatus as claimed in claim 1, wherein the toner has a mean circularity of 0.90 or above, but below 1.00.

10. The apparatus as claimed in claim 1, wherein the carrier has a volume-mean grain size of 25 μm or above, but 55 μm or below.

11. The apparatus as claimed in claim 1, wherein said image carrier is photoconductive and allows the latent image to be formed thereon by being uniformly exposed and then exposed imagewise, and wherein there holds a relation:

$$0 < |VD| - |VB| < |VD - VL| < 400(V)$$

where VD denotes a potential deposited on said image carrier by uniform charging, VL denotes a potential after exposure, and VB denotes a bias for development.

12. The apparatus as claimed in claim 11, wherein the bias comprises a DC bias.

* * * * *